US007992953B2

(12) United States Patent
Yorimoto et al.

(10) Patent No.: US 7,992,953 B2
(45) Date of Patent: Aug. 9, 2011

(54) IMAGE FORMING APPARATUS AND METHOD OF CORRECTING DEVIATION OF SHOOTING POSITION

(75) Inventors: Mamoru Yorimoto, Tokyo (JP); Noboru Sawayama, Kanagawa (JP); Kenichi Kawabata, Kanagawa (JP); Tetsu Morino, Kanagawa (JP); Tetsuro Hirota, Kanagawa (JP); Takumi Hagiwara, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 818 days.

(21) Appl. No.: 12/047,945

(22) Filed: Mar. 13, 2008

(65) Prior Publication Data

US 2008/0225066 A1 Sep. 18, 2008

(30) Foreign Application Priority Data

Mar. 17, 2007 (JP) ..... 2007-069673

(51) Int. Cl.
*B41J 29/38* (2006.01)
*B41J 29/393* (2006.01)

(52) U.S. Cl. ..... 347/14; 347/19

(58) Field of Classification Search ..... None
See application file for complete search history.

(56) References Cited

U.S. PATENT DOCUMENTS

| | | | | |
|---|---|---|---|---|
| 4,644,372 | A | 2/1987 | Hirota | |
| 4,661,822 | A | 4/1987 | Hirota et al. | |
| 5,754,202 | A | 5/1998 | Sekiya et al. | |
| 5,818,482 | A | 10/1998 | Ohta et al. | |
| 5,821,953 | A | 10/1998 | Nakano et al. | |
| 6,053,597 | A | 4/2000 | Hirota | |
| 6,331,052 | B1 | 12/2001 | Murai et al. | |
| 6,422,678 | B1 * | 7/2002 | Serra et al. | 347/19 |
| 6,735,401 | B2 * | 5/2004 | Kajiwara et al. | 399/49 |
| 7,384,117 | B2 * | 6/2008 | Shoki et al. | 347/19 |
| 7,505,057 | B2 * | 3/2009 | Yoshida | 347/116 |
| 2005/0073539 | A1 * | 4/2005 | McGarry et al. | 347/14 |
| 2005/0194730 | A1 | 9/2005 | Nishida et al. | |

FOREIGN PATENT DOCUMENTS

| | | |
|---|---|---|
| JP | 4-39041 | 2/1992 |
| JP | 5-249787 | 9/1993 |
| JP | 2005-342899 | 12/2005 |
| JP | 2006-178396 | 7/2006 |
| JP | 3838251 | 8/2006 |
| JP | 2006-313251 | 11/2006 |

* cited by examiner

*Primary Examiner* — Omar Rojas

(74) *Attorney, Agent, or Firm* — Cooper & Dunham LLP

(57) ABSTRACT

An adjustment pattern, which is composed of a reference pattern made of plural independent liquid droplets and a pattern to be measured made of plural independent liquid droplets ejected under an ejection condition different from the reference pattern, is formed on a water-repellent conveying belt. Then, light is applied to the adjustment pattern to receive the regular reflection light from the adjustment pattern, so that the adjustment pattern is scanned. The distance between the respective patterns is measured based on the measured result. Finally, liquid droplet ejection timing of the recording head is corrected based on the result thus measured.

10 Claims, 25 Drawing Sheets

IMAGE FORMING APPARATUS AND METHOD OF CORRECTING DEVIATION OF SHOOTING POSITION

BACKGROUND OF THE INVENTION

1. Field of the Invention

The present invention relates to an image forming apparatus including a recording head that ejects liquid droplets and a method of correcting the shooting positions of the liquid droplets ejected from the recording head.

2. Description of the Related Art

As an image forming apparatus such as a printer, a facsimile machine, a copier, and a complex machine thereof, there is employed, e.g., a liquid ejection apparatus including a recording head composed of liquid ejection heads (liquid droplet ejection heads) that eject the liquid droplets of recording liquid (liquid) so as to perform image formation. In performing the image formation (that is used synonymously with recording, printing, and imaging), this liquid ejection apparatus causes recording liquid as liquid (hereinafter referred to as ink) to adhere to a sheet, while transferring a medium (hereinafter referred also to as the "sheet," but it does not limit a material. Also, it is used synonymously with a medium to be recorded, a recording medium, a transfer member, a recording paper, etc.).

Note that the image forming apparatus refers to an apparatus that ejects liquid onto a medium such as a paper, a thread, a fiber, a fabric, leather, metal, a plastic, glass, wood, and a ceramic so as to perform the image formation. Furthermore, the "image formation" refers to forming on the medium not only meaningful images such as characters and graphics, but also meaningless images such as patterns. That is, the image forming apparatus refers also to a textile printing apparatus or an apparatus that forms a metal wiring. Furthermore, the "liquid" is not particularly limited so long as it is capable of performing the image formation.

When the image forming apparatus of such a liquid droplet ejection type causes a carriage, on which the recording heads that eject liquid droplets are mounted, to reciprocate so as to print the images of ruled lines bi-directionally, the deviation of the ruled lines is liable to occur in the forward and backward directions.

Generally, in an ink jet recording apparatus or the like, a test chart for adjusting the deviation of ruled lines is manually output so that users select and input an optimum value. Accordingly, ejection timing is adjusted based on the input results. However, viewing the test chart varies between users, and data are likely to be erroneously input because users are unaccustomed to the operations. As a result, an adjustment problem may be adversely incurred.

As one of the conventional image forming apparatuses of the liquid droplet ejection type, Patent Document 1 discloses an apparatus that prints test patterns on a recording medium or a transfer belt, scans the color data of the test patterns, and changes the driving conditions of heads based on the scanned results so as to correct density irregularities.

Patent Document 1: JP-A-4-39041

Furthermore, Patent Document 2 discloses an apparatus that forms the test patterns of mixed color dots made of cyan ink, magenta ink, and yellow ink in a prescribed area on a member for holding and transferring a print medium, scans the mixed color dots with a RGB sensor, and detects an ejection failure nozzle based on the scanned results.

Patent Document 2: Japanese Patent No. 3838251

Furthermore, Patent Document 3 discloses an apparatus that records on a part of a transfer belt the test patterns of either any of or the combination of a defective nozzle pattern for detecting a defective nozzle, a color shift pattern for detecting the color shift of ink, and a head position adjustment pattern for adjusting the position of recording heads; scans the test patterns with an image pickup unit such as a CCD; and makes a correction based on the scanned results.

Patent Document 3: JP-A-2005-342899

As the image forming apparatus of an electrophotographic type using toner, on the other hand, Patent Document 4 discloses an apparatus that forms toner images on a photoconductive drum and individually detects the density of the toner images having different characteristics with light emitting elements and light receiving elements wherein the light receiving elements serve to receive regular reflection light and diffused reflection light.

Patent Document 4: JP-A-5-249787

Furthermore, Patent Document 5 discloses an apparatus that detects a toner adhesion amount using the output obtained according to the results of a sensor capable of simultaneously detecting the regular reflection light and the diffused reflection light from toner images.

Patent Document 5: JP-A-2006-178396

SUMMARY OF THE INVENTION

However, as described in Patent Documents 1 through 3, when the test patterns are formed on the transfer belt and the colors for detecting the test patterns are detected or picked up, it is difficult to scan the test patterns accurately because their color difference is small depending, for example, on the combination of the color of the transfer belt and that of the ink. In this case, it is necessary to use an expensive unit such as a light source whose wavelength is varied for each color so as to detect the colors accurately. If there is employed, as the transfer belt, an electrostatic belt composed of an insulating layer on its surface and an intermediate resistive layer on its rear surface and incorporating carbon to provide the intermediate resistive layer with a conductive property, the color of the electrostatic belt is black in appearance. Therefore, when the test patterns are detected only by the reflection of the colors and the pickup by the pickup unit, it is difficult to distinguish black ink from the electrostatic belt. As a result, it is not possible to perform the detection with high accuracy.

More specifically, since the apparatus of Patent Document 1 for correcting density irregularities scans colors as a sensor, detection accuracy could be lowered if the colors of ink droplets to be ejected approximate that of a holding and transferring member. In addition, since the apparatus is required to have a filter for each color, the variety of sensors and filters increases to thereby cause high cost. Furthermore, since the apparatus of Patent Document 2 for detecting the failure of nozzles scans the mixed color dots with the RGB sensor, detection accuracy could be lowered if the colors of ink droplets to be ejected approximate that of a holding and transferring unit. In case that the detection accuracy is improved, the combination of the ink to be used and the transferring member is limited. Moreover, when a laser beam is used to detect the failure of nozzles, an extremely limited point is scanned. Therefore, since the scanning is susceptible to small foreign matter particles and flaws on the transferring member, detection accuracy may be lowered. The RGB sensor needs at least units for scanning each color, thereby increasing costs. Furthermore, as in the case of Patent Document 2, detection accuracy could be lowered if the colors of ink droplets to be ejected approximate that of a holding and transferring member in the apparatus using the pickup unit of Patent Document 3. In addition, since the apparatus recognizes the test patterns as two-dimensional images, it needs a relatively high performance processing system compared with a case where one-dimensional images are recognized, thereby increasing costs.

In view of the above problems, the application of detecting a toner adhesion amount in the electrophotographic method as described in Patent Documents 4 and 5 is considered. However, toner particles maintain their shape even if the toner particles are brought into contact with each other. Therefore, the scanning can be made at a part where toner particles are closely packed such that they become thick on a rectangular line. If this method is applied to the image forming apparatus of the liquid ejection type as it is, obtained results are only at a level at which they are not so different from noise, although detection itself is made possible because liquid droplets may be aggregated. As a result, it is not possible to detect the test patterns with high accuracy.

Furthermore, if the test patterns are formed on a plain paper as a recording medium through which so-called ink permeates so that they are scanned by an optical sensor, blurring may occur due to the permeation of the ink and the patterns could be washed out. As a result, it is not possible to detect the shooting positions accurately.

The present invention has been made in view of the above problems and has an object of detecting an adjustment pattern composed of liquid droplets for correcting the deviation of shooting positions with high accuracy, thereby realizing high-accuracy shooting position detection and shooting position deviation correction.

According to one aspect of the present invention, there is provided an image forming apparatus that includes a recording head that ejects a liquid droplet and forms an image on a conveyed medium to be recorded. The apparatus comprises a pattern forming section that forms on a water-repellent member a reference pattern composed of plural independent liquid droplets and a pattern to be measured composed of plural independent liquid droplets ejected under an ejection condition different from the reference pattern so as to be arranged in parallel in a scanning direction of the recording head; a scanning section composed of a light emitting section that emits light to the respective patterns and a light receiving section that receives regular reflection light from the respective patterns; and a correcting section that measures the distance between the respective patterns based on a scanned result of the scanning section and corrects liquid droplet ejection timing of the recording head based on the result thus measured.

Here, the plural liquid droplets may be regularly arranged in the respective patterns. Furthermore, the plural liquid droplets may be arranged at intervals of one dot in the respective patterns. Furthermore, the plural liquid droplets may be arranged in the respective patterns in a staggered manner. Furthermore, plural of the reference patterns and the patterns to be measured are preferably alternately formed. Furthermore, the reference pattern and the pattern to be measured are preferably formed by the same recording head in reversed scanning directions. Furthermore, the reference pattern and the pattern to be measured are preferably formed by different recording heads. Furthermore, combinations of the reference pattern and the pattern to be measured are preferably formed at plural parts on the water-repellent member. Furthermore, the reference pattern and the pattern to be measured are preferably not formed at a part where a surface property of the water-repellent member is changed.

According to another aspect of the present invention, there is provided a method of correcting a shooting position of a liquid droplet ejected from a recording head. The method comprises the steps of forming on a water-repellent member a reference pattern composed of plural independent liquid droplets and a pattern to be measured composed of plural independent liquid droplets ejected under an ejection condition different from the reference pattern so as to be arranged in parallel in a scanning direction of the recording head; scanning the respective patterns by receiving regular reflection light from the respective patterns after applying light thereto; and correcting liquid droplet ejection timing of the recording head based on a measured result after measuring a distance between the respective patterns based on the scanned result.

According to the image forming apparatus and the method of correcting the deviation of shooting positions of liquid droplets of the present invention, the reference pattern made of plural independent liquid droplets and the pattern to be measured made of plural independent liquid droplets ejected under the condition different from the reference pattern are formed parallel on the water-repellent member in the scanning direction of the recording heads. Furthermore, light is applied to the respective patterns and the regular reflection light is received therefrom so as to scan the patterns. Based on the scanned result, the distance between the patterns is measured so that liquid droplet ejection timing of the recording heads is corrected. Therefore, it is possible to accurately detect the shooting positions of liquid droplets with a simple configuration and accurately correct the deviation of the shooting positions of liquid droplets.

Other objects, features and advantages of the present invention will become more apparent from the following detailed description when read in conjunction with the accompanying drawings.

DETAILED DESCRIPTION OF THE PREFERRED EMBODIMENTS

Figure 1:
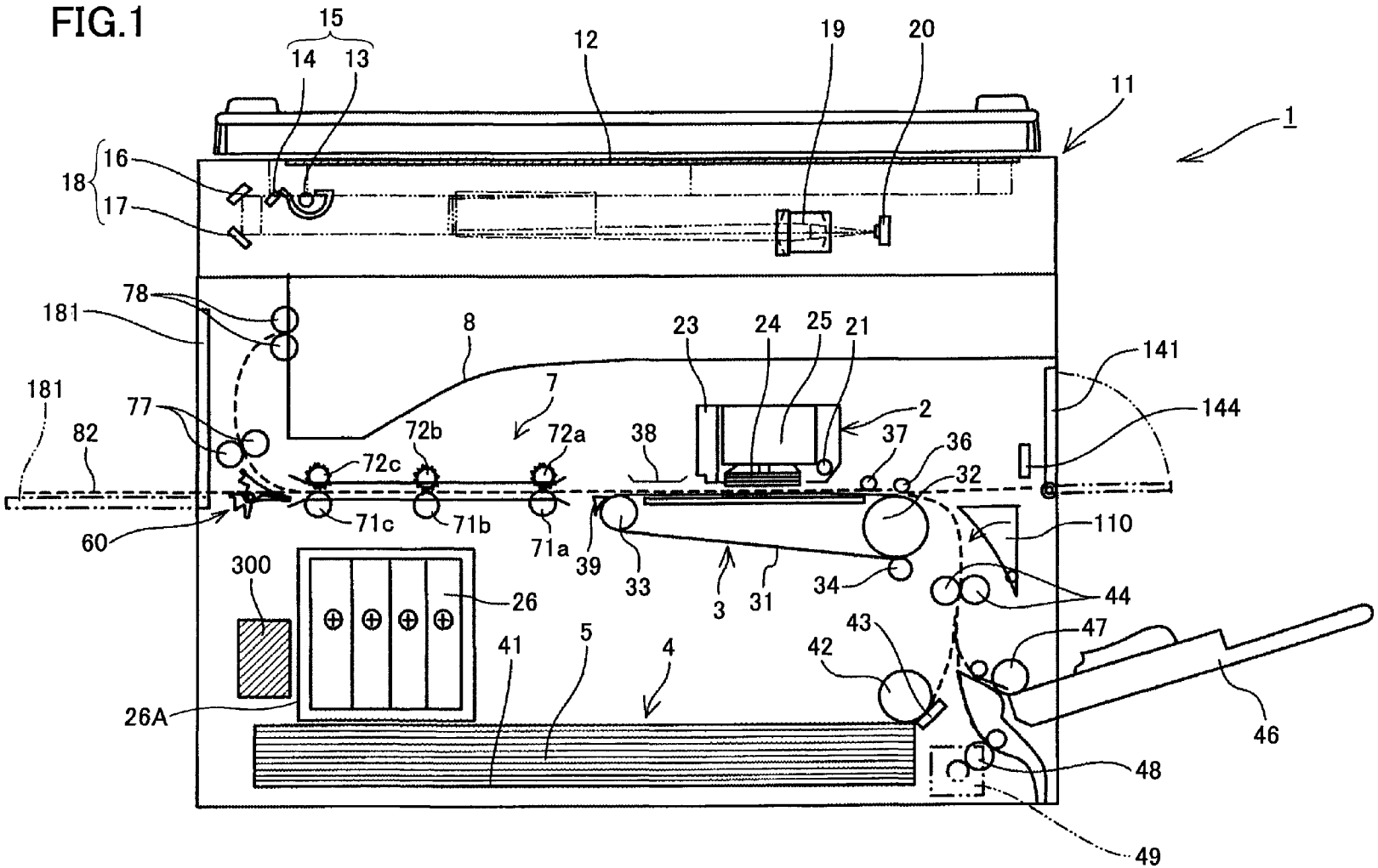
FIG. 1 is a schematic view showing an entire configuration of an image forming apparatus according to an embodiment of the present invention.
Figure 2:
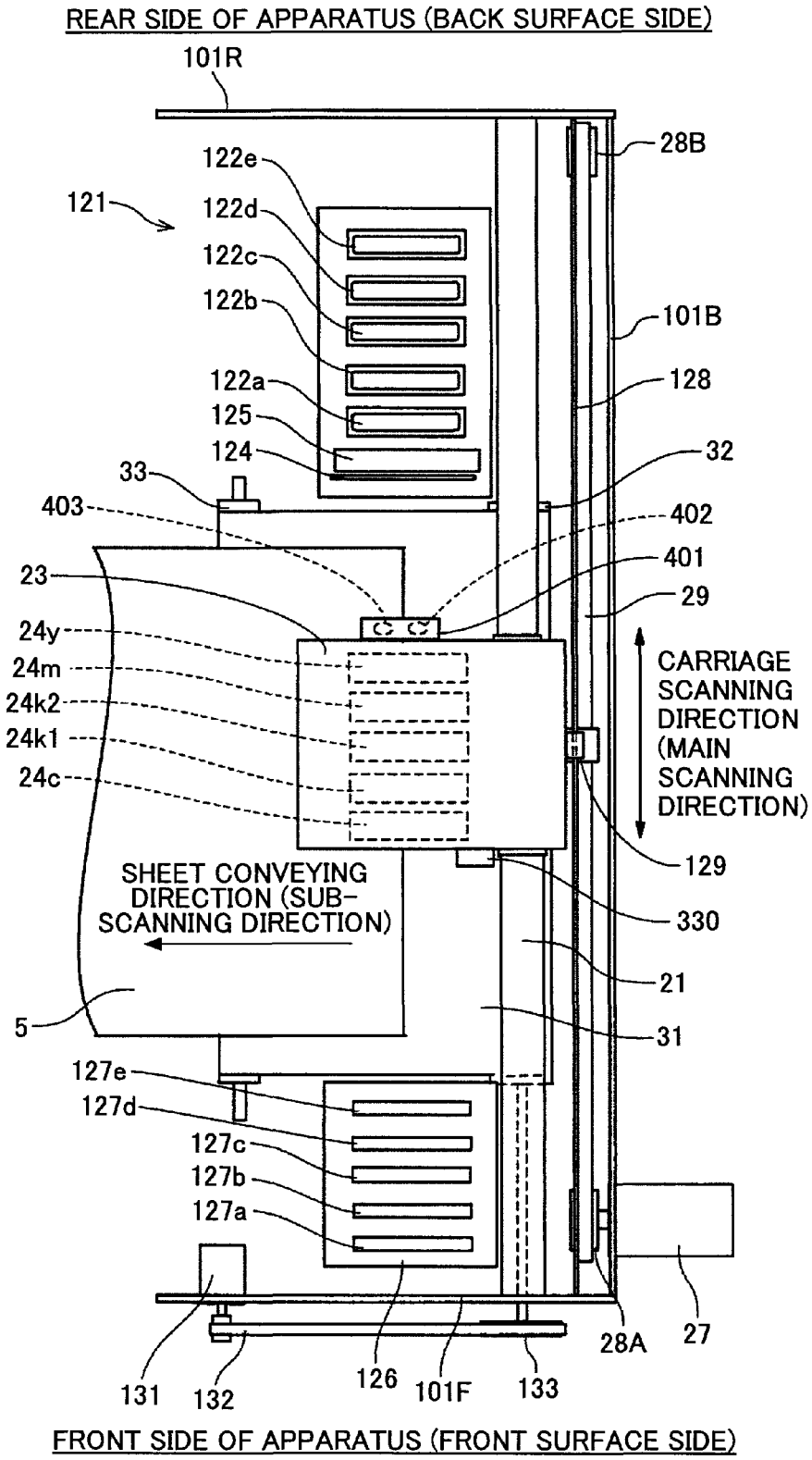
FIG. 2 is a plan view showing an image forming section and a sub-scanning conveying section of the image forming apparatus.
Figure 3:
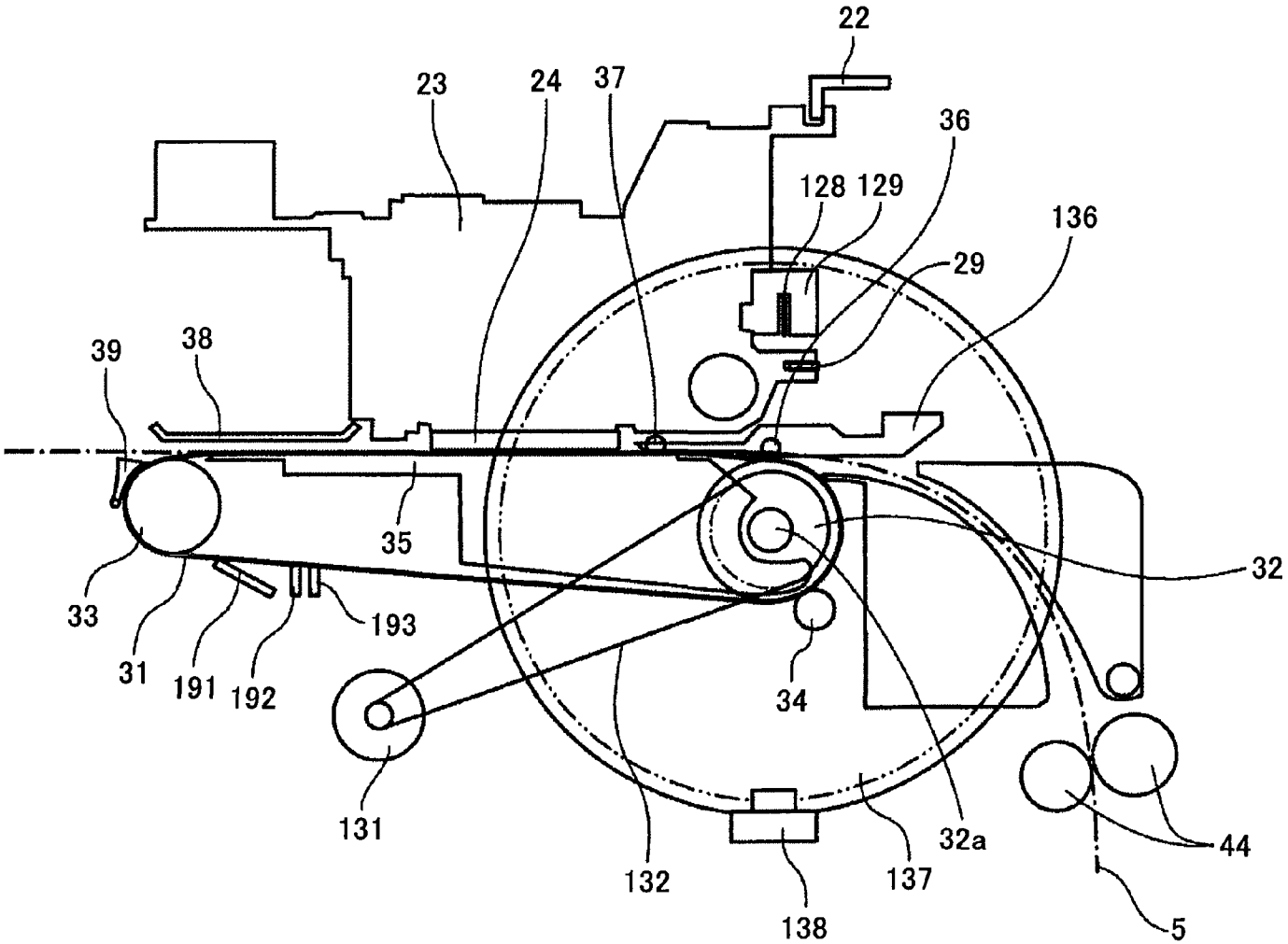
FIG. 3 is a side view showing the image forming apparatus and sub-scanning conveying section in a partially transparent state.

Next, referring to the accompanying drawings, a description is made of an embodiment of the present invention. FIGS. 1 through 3 describe a general outline of an example of an image forming apparatus according to the embodiment of the present invention. Note that FIGS. 1, 2, and 3 are a schematic view showing an entire configuration of the image forming apparatus, a plan view showing an image forming section and a sub-scanning conveying section of the image forming apparatus, and a side view showing the image forming apparatus and sub-scanning conveying section in a partially transparent state, respectively.

The image forming apparatus includes an image forming section (means) 2 that forms images while conveying a sheet, a sub-scanning conveying section (means) 3 that conveys the sheet, and the like inside (in the housing of) an apparatus main body 1. In the image forming apparatus, a sheet 5 is individually fed from a sheet feeding section (means) 4 including a sheet feeding cassette provided at the bottom of the apparatus main body 1. Then, after the image forming section 2 ejects liquid droplets onto the sheet 5 to form (record) desired images thereon as the sheet 5 is conveyed at the position opposing the image forming section 2 by the sub-scanning conveying section 3, the sheet 5 is discharged onto a sheet discharging tray 8 formed on the upper surface of the apparatus main body 1 through a sheet discharge conveying section (means) 7.

Furthermore, the image forming apparatus further includes, as an input system for image data (print data) formed by the image forming section 2, an image scanning section (scanner section) 11 placed at the upper part of the apparatus main body 1 above the sheet discharging tray 8 so as to scan images. In the image scanning section 11, a scanning optical system 15 including an illumination source 13 and a mirror 14 and a scanning optical system 18 including mirrors 16 and 17 are moved to scan a document image placed on a contact glass 12. The scanned image of the document is read as an image signal by an image scanning element 20 arranged in a backward position of a lens 19. The read image signal is digitized and subjected to image processing, thus allowing the print data subjected to the image processing to be printed.

As shown in FIG. 2, in the image forming section 2 of the image forming apparatus, a cantilevered carriage 23 is movably held in the main scanning direction by a guide rod 21 and a guide rail (not shown) and moved to scan in the main scanning direction by a main scanning motor 27 through a timing belt 29 wound around a drive pulley 28A and a driven pulley 28B.

As shown in FIG. 2, in the image forming section 2 of the image forming apparatus, the carriage 23 is movably held in the main scanning direction by the lateral carriage guide (guide rod) 21 provided between a front plate 101F and a rear plate 101R and a guide stay 22 provided in a rear stay 101B and is moved to scan in the main scanning direction by the main scanning motor 27 through the timing belt 29 suspended between the drive pulley 28A and the driven pulley 28B.

The carriage 23 has five liquid droplet ejection heads mounted thereon including recording heads 24*k*1 and 24*k*2 consisting of two liquid droplet ejection heads for ejecting black (K) ink and recording heads 24*c*, 24*m*, and 24*y* (referred to as a "recording head 24" when colors are not differentiated from each other or when the recording heads are given a numeric name) consisting of one liquid droplet ejection head for ejecting cyan (C) ink, magenta (M) ink, and yellow (Y) ink, respectively. The image forming apparatus is a shuttle-type which moves the carriage 23 in the main scanning direction and causes liquid droplets to be ejected from the recording head 24 so as to form images as the sheet 5 is fed in the sheet conveying direction (sub-scanning direction) by the sub-scanning conveying section 3.

Furthermore, the carriage 23 has sub-tanks 25 mounted thereon to supply required colors of recording liquid to the corresponding recording heads 24. On the other hand, as shown in FIG. 1, ink cartridges 26 as recording liquid cartridges storing black (K) ink, cyan (C) ink, magenta (M) ink, and yellow (Y) ink, can be detachably loaded into a cartridge loading section 26A from the front side of the apparatus main body 1, and ink (recording liquid) is supplied from the colors of ink cartridges 26 to replenish the corresponding colors of the sub-tanks 25 through tubes (not shown). Note that the black ink is supplied from the one ink cartridge 26 to two sub-tanks 25.

Examples of the recording head 24 include a so-called piezoelectric type in which a piezoelectric element as a pressure generator (actuating means) that increases the pressure of ink in an ink channel (pressure generating chamber) is used to deform a vibration plate forming a wall surface of the ink channel to change the volume of the ink channel, thereby ejecting ink droplets. Furthermore, a so-called thermal type can also be used in which the pressure generated by heating ink in an ink channel with a heating element to produce air bubbles is used to eject ink droplets. Furthermore, an electrostatic type can also be used in which the electrostatic force generated between a vibrating plate and an electrode is used to deform the vibrating plate where the vibrating plate forming a wall surface of an ink channel and the electrode are arranged to oppose each other to change the volume of the ink channel, thereby ejecting ink droplets.

Furthermore, a linear scale 128 having slits is extended between the front and rear plates 101F and 101R along the main scanning direction of the carriage 23, and an encoder sensor 129 composed of a transmission-type photosensor that detects the slits formed in the linear scale 128 is provided in the carriage 23. The linear scale 128 and the encoder sensor 129 constitute a linear encoder that detects the movement of the carriage 23.

Furthermore, on one side surface of the carriage 23 there is provided a pattern scanning sensor (DRESS sensor) 401 as a scanning section (detection means) composed of a reflective photosensor including a light emitting element and a light receiving element for detecting (scanning patterns) the deviation of shooting positions according to the embodiment of the present invention. As described below, this pattern scanning sensor 401 scans an adjustment pattern composed of a reference pattern and a pattern to be measured used for detecting the shooting positions formed on the conveying belt 31. In addition, on the other side surface, there is provided a sheet member detecting sensor (tip end detecting sensor) 330 as a sheet member detecting section for detecting the tip end of a member to be conveyed.

Moreover, a maintenance and recovery mechanism (apparatus) 121 that maintains and recovers the operational capability of the nozzles of the recording head 24 is arranged in a non-printing area on one side in the scanning direction of the carriage 23. The maintenance and recovery mechanism 121 includes one suction cap 122*a* serving also as a moisturizing item and four moisturizing caps 122*b* through 122*e* as cap members that cap corresponding nozzle surfaces 24*a* of the five recording heads 24, a wiper blade 124 as a wiping member that wipes off the nozzle surface 24*a* of the recording head 24, and an idle ejection receiver 125 for idle ejection. Furthermore, an idle ejection receiver 126 for idle ejection is arranged in a non-printing area on the other side in the scanning direction of the carriage 23. The idle ejection receiver 126 has openings 127*a* through 127*e* formed therein.

As shown in FIG. 3, the sub-scanning conveying section 3 includes an endless conveying belt 31 wound around a conveying roller 32 as a drive roller and a driven roller 33 as a tension roller to change the conveying direction of the sheet 5 fed from the lower side of the apparatus main body 1 by approximately 90 degrees so as to convey the sheet 5 in the direction opposing the image forming section 2; a charging roller 34 as a charging section to which a high voltage alternating current is applied from a high-voltage power supply to charge the surface of the conveying belt 31; a guide member 35 that guides the conveying belt 31 at the area opposing the image forming section 2; pressure rollers 36 and 37 that are rotatably held by a holding member 136 and press the sheet 5 against the conveying belt 31 at the position opposing the conveying roller 32; a guide plate 38 that presses the top surface of the sheet 5 where images are formed by the image forming section 2; and a separating claw 39 that separates the sheet 5 where images are formed by the image forming section 2 from the conveying belt 31.

Figure 4:
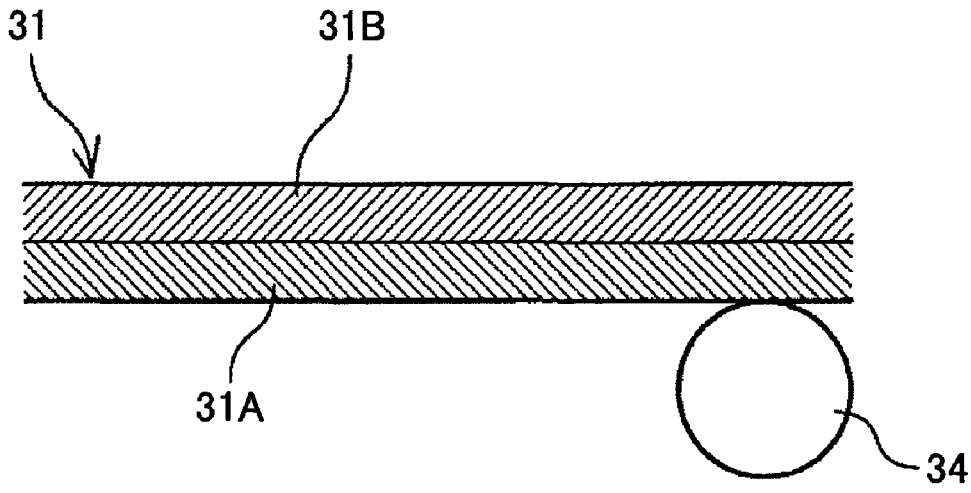
FIG. 4 is a cross-sectional view showing an example of a conveying belt.

The conveying belt 31 is configured to rotate in the sheet conveying direction (sub-scanning direction) as the conveying roller 32 is rotated by a sub-scanning motor 131 that is a DC brushless motor through a timing belt 132 and a timing roller 133. As shown in FIG. 4, the conveying belt 31 has a double layered structure composed of a front layer 31A serving as a sheet attraction surface made of a pure resin material such as ETFE in which resistance control is not effected and a rear layer (such as an intermediate resistance layer and a ground layer) 31B made of the same material as the front layer in which resistance control is effected by carbon. However, the conveying belt 31 is not limited to this in its structure, and it may have a single or a three or more layered structure.

Between the driven roller 33 and the charging roller 34 there are provided a Mylar sheet (paper dust removing section) 191, a cleaning brush 192, and an electricity removing brush 193 from the upstream side in the moving direction of the conveying belt 31. The Mylar sheet 191 serves as a cleaning section for removing paper dust or the like adhering onto the surface of the conveying belt 31 and is made of a PET film as a contact member that contacts the surface of the conveying belt 31, the cleaning brush 192 has a brush shape and contacts the surface of the conveying belt 31, and the electricity removing brush 193 removes charges on the surface of the conveying belt 31.

Moreover, a high-resolution code wheel 137 is attached to a shaft 32*a* of the conveying roller 32, and an encoder sensor 138 composed of a transmission-type photosensor that detects a slit 137*a* formed in the code wheel 137 is provided. The code wheel 137 and the encoder sensor 138 constitute a rotary encoder.

The sheet feeding section 4 includes a sheet feeding cassette 41 that can be inserted in and extracted from the apparatus main body 1 and serves as storage section for storing multiple sheets 5 in a stacked manner, a sheet feeding roller 42 and a friction pad 43 that individually separate and feed the sheets 5 of the sheet feeding cassette 41, and a pair of resist rollers 44 that resist the fed sheet 5.

Furthermore, the sheet feeding section 4 includes a manual feeding tray 46 that stores multiple sheets 5 in a stacked manner, a manual feeding roller 47 used to individually feed a sheet 5 from the manual feeding tray 46, and a vertically conveying roller 48 used to convey the sheet 5 fed from a sheet feeding cassette or a double-sided unit optionally attached on the bottom side of the apparatus main body 1. Such members as the sheet feeding roller 42, the resist rollers 44, the manual feeding roller 47, and the vertically conveying roller 48, which are used to feed the sheet 5 to the sub-scanning conveying section 3, are driven to rotate by a sheet feeding motor (driving section) 49 composed of a HB stepping motor through an electromagnetic clutch (not shown).

The sheet discharge conveying section 7 includes three conveying rollers 71*a*, 71*b*, and 71*c* (referred to as a "conveying roller 71" as a whole) that convey the sheet 5 separated by the separating claws 39 of the sub-scanning conveying section 3; spurs 72*a*, 72*b*, and 72*c* (referred to as a "spur 72" as a whole) opposing the conveying rollers 71*a*, 71*b*, and 71*c*; and a pair of sheet inversion rollers 77 and 78 that inverts the sheet 5 to be fed to the sheet discharging tray 8 face-down.

As shown in FIG. 1, a manual sheet feeding tray 141 is provided in an openable/closable manner (in a manner capable of falling open) on one lateral side of the apparatus main body 1 to feed a sheet manually. At the time of feeding the sheet manually, the manual sheet feeding tray 141 is opened to the position indicated by an imaginary line in FIG. 1. The sheet 5 manually fed from the manual sheet feeding tray 141 can be guided on the top surface of the guide plate 110 and linearly inserted between the conveying roller 32 and the pressure roller 36 of the sub-scanning conveying section 3 as it is.

On the other hand, a straight sheet discharging tray 181 is provided in an openable/closable manner (in a manner capable of falling open) on the other lateral side so that the sheet 5 where images are formed is discharged straight out and face-up. By opening the straight sheet discharging tray 181, it is possible to discharge the sheet 5 fed from the sheet discharge conveying section 7 to the straight sheet discharging tray 181 along a straight path.

Figure 5:
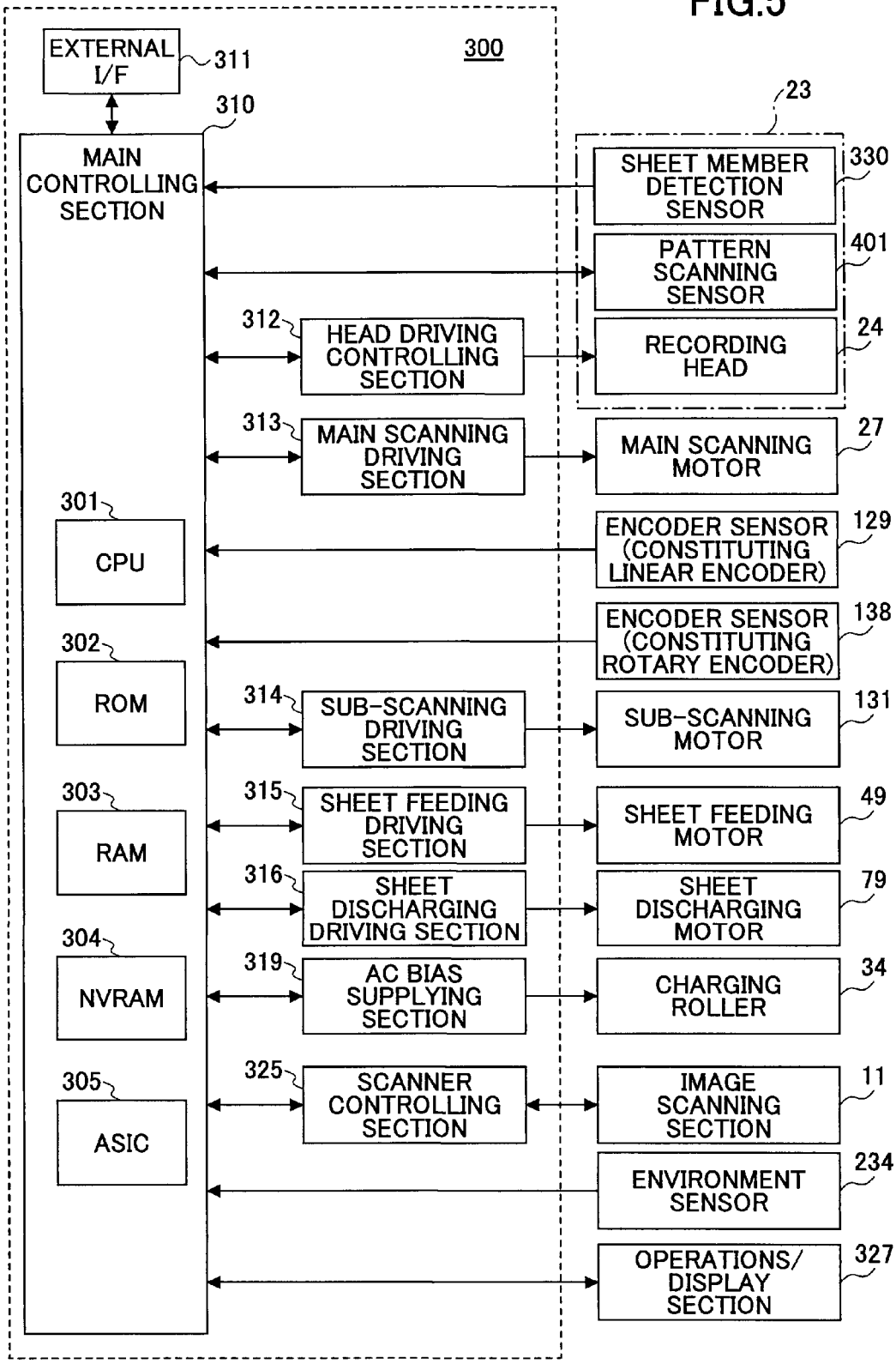
FIG. 5 is a block diagram for explaining a brief outline of a control block of the image forming apparatus.

Referring next to the block diagram of FIG. 5, a description is made of a brief outline of a control block of the image forming apparatus.

The control block 300 includes a main controlling section 310 having a CPU 301, a ROM 302 that stores the programs executed by the CPU 301 and other fixation data, a RAM 303 that temporarily stores image data and the like, a non-volatile memory (NVRAM) 304 that maintains data even while the power of the apparatus is interrupted, and an ASIC 305 that processes various signals to and from image data and input/output signals for controlling the entire apparatus and image processing in which images are arranged. The main controlling section 310 controls the formation of an adjustment pattern according to the embodiment of the present invention, the detection of the adjustment pattern, and the adjustment (correction) of shooting positions as well as the entire apparatus.

Furthermore, the control block 300 includes an external I/F 311, a head driving controlling section 312, a main scanning driving section (motor driver) 313, a sub-scanning driving section (motor driver) 314, a sheet feeding driving section 315, a sheet discharging driving section 316, an AC bias supplying section 319, and a scanner controlling section 325. The external I/F 311 is interposed between a host and the main controlling section 310 and transmits and receives data and signals. The head driving controlling section 312 includes a head driver (that is actually provided at the recording head 24) composed, e.g., of a head data generation and arrangement converting ASIC used to control the driving of the recording head 24. The main scanning driving section 313 drives the main scanning motor 27 that moves the carriage 23 to perform a scanning operation. The sub-scanning driving section 314 drives the sub-scanning motor 131. The sheet feeding driving section 315 drives the sheet feeding motor 49. The sheet discharging driving section 316 drives a sheet discharging motor 79 that drives each roller of the sheet discharge conveying section 7. The AC bias supplying section 319 supplies an AC bias to the charging roller 34. Although not shown in FIG. 5, the scanner controlling section 325 controls a recovery system driving section that drives a maintenance and recovery motor to drive the maintenance and recovery mechanism 121, a double-side driving section that drives a double-sided unit when the double-sided unit is mounted, a solenoids driving section (driver) that drives various solenoids (SOL), a clutch driving section that drives an electromagnetic clutch and the like, and the image scanning section 11.

Furthermore, the various detection signals from an environment sensor 234 that detects ambient temperature and humidity (environmental conditions) of the conveying belt 31 are input to the main controlling section 310. Note that although the detection signals from various sensors (not shown) are also input to the main controlling section 310, they are omitted here. Moreover, the main controlling section 310 imports a necessary key input and exports display information from and to an operations/display section 327 including various keys such as a numeric key pad and a print start key provided in the apparatus main body 1 and various display devices.

Furthermore, the output signal from the photosensor (encoder sensor) 138 constituting a linear encoder that detects the position of the carriage is input to the main controlling section 310. The main controlling section 310 controls the driving of the sub-scanning motor 131 through the main scanning driving section 313 based on this output signal, thereby making the carriage 23 reciprocate in the main scanning direction. In addition, the output signal (pulse) from the photosensor (encoder sensor) 138 constituting a rotary encoder 138 that detects the movement amount of the conveying belt 31 is input to the main controlling section 310. The main controlling section 310 controls the driving of the sub-scanning motor 131 through the sub-scanning driving section 314 based on this output signal, thereby making the conveying belt 31 move through the rotation of the conveying roller 32.

Moreover, the main controlling section 310 forms an adjustment pattern on the conveying belt 31 and causes a light emitting element 402 of the pattern scanning sensor 401 mounted on the carriage 23 to emit light to the formed adjustment pattern. At the same time, the main controlling section 310 receives the output signal from a light receiving element 403 to scan the adjustment patterns, detects the deviation amount of shooting positions from the scanned results, and corrects liquid droplet ejection timing of the recording head 24 based on the deviation amount of the shooting positions so as to eliminate the deviation of the shooting positions. Note that this controlling operation is described in detail below.

The image forming apparatus having such a configuration detects the rotation amount of the conveying roller 32 that drives the conveying belt 31, controls the driving of the sub-scanning motor 131 in accordance with the detected rotation amount, and applies rectangular-wave high voltage of positive and negative poles as alternating current to the charging roller 34 from the AC bias supplying section 319. Accordingly, positive and negative electric charges are alternately applied to the conveying belt 31 in the conveying direction thereof in a belt shape, so that the conveying belt 31 is charged in a prescribed charging width to generate a non-uniform electric field.

When the sheet 5 is fed from the sheet feeding section 4, delivered between the conveying roller 32 and the first pressure roller 36, and placed on the conveying belt 31 where the positive and negative charges are formed to generate the non-uniform electric field, it is instantaneously polarized to follow the direction of the electric field, attached onto the conveying belt 31 by an electrostatic attraction force, and conveyed along with the movement of the conveying belt 31.

The sheet 5 is intermittently conveyed by the conveying belt 5. Then, between the conveyances the carriage 23 is caused to move in the main scanning direction so that liquid droplets of a recording liquid are ejected from the recording head 24 onto the sheet 5 to record (print) images thereon. The sheet 5 on which printing is performed is separated from the conveying belt 31 at its tip end by the separating claw 39, delivered to a sheet discharge conveying section 6, and discharged to the sheet discharging tray 8.

Furthermore, during standby for performing a printing (recording) operation, the carriage 23 is moved to the side of the maintenance and recovery mechanism 121 where the nozzle surface of the recording head 24 is capped by the cap 122 to keep the nozzles moist, thereby preventing an ejection failure due to the drying of ink. Furthermore, recording liquid is suctioned where the recording head 24 is capped by the suction and moisturizing cap 122*a* to perform a recovery operation in which the recording liquid increased in viscosity and air bubbles are discharged. In the recovery operation, the wiper blade 124 is used to perform a wiping operation to clean and remove the ink adhering onto the nozzle surface of the recording head 24. Furthermore, idle ejection is performed before the start of or in the middle of recording images in which the ink not used for the recording is ejected into the idle ejection receiver 125, thereby maintaining the stable ejection performance of the recording head 24.

Figure 6:
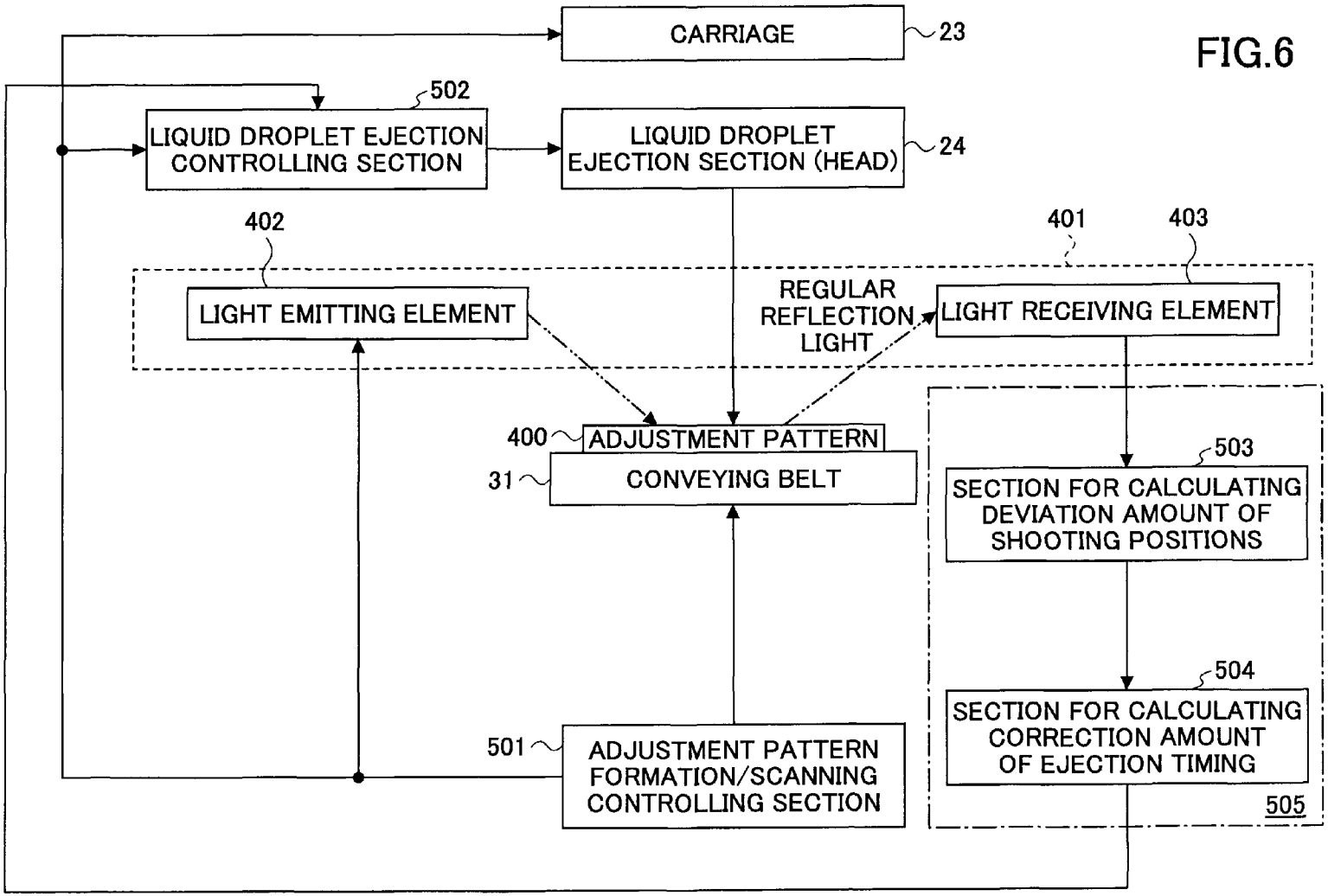
FIG. 6 is a block diagram for functionally explaining a section related to detecting the shooting positions of liquid droplets and correcting the shooting positions of liquid droplets according to a first embodiment of the present invention.
Figure 7:
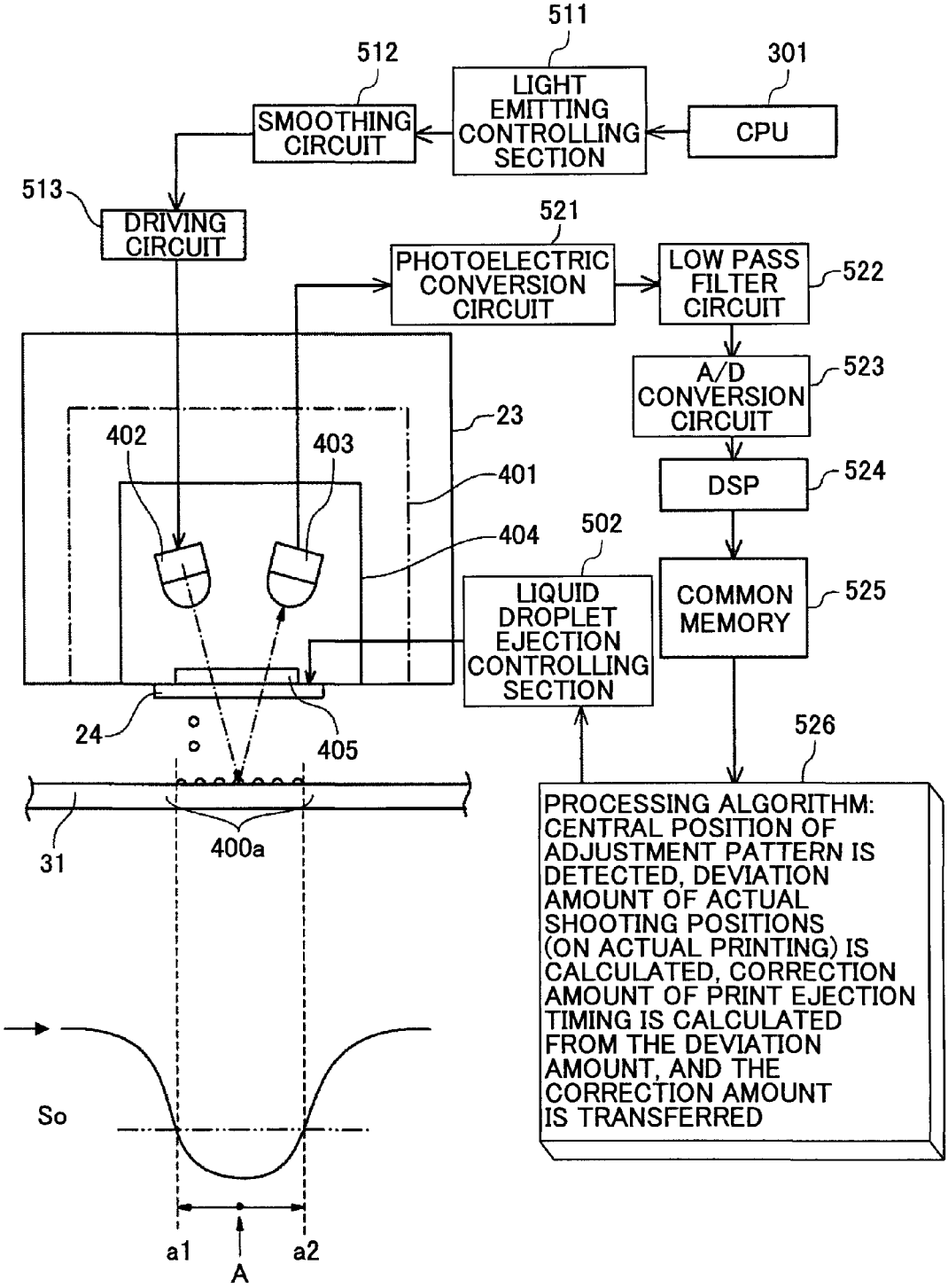
FIG. 7 is a block diagram for functionally explaining a specific example of the section related to detecting the shooting positions of liquid droplets and correcting the shooting positions of liquid droplets according to the first embodiment of the present invention.
Figure 8:
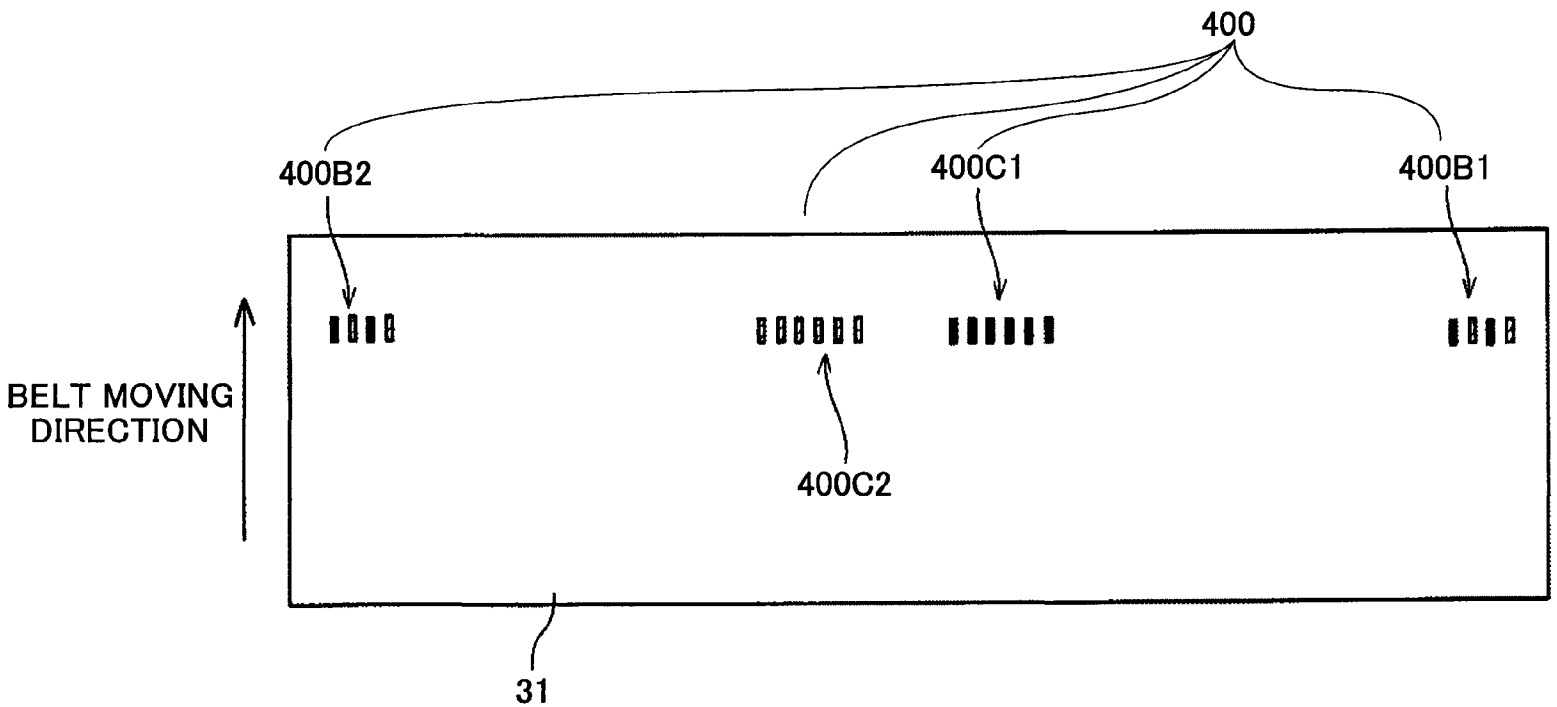
FIG. 8 is a diagram for explaining an example of an adjustment pattern.

Referring next to FIGS. 6 and 7, a description is made of a part related to control for correcting the deviation of shooting positions of liquid droplets in the image forming apparatus. Note that FIGS. 6 and 7 are a block diagram functionally explaining a section for correcting the deviation of shooting positions of liquid droplets and a block diagram showing a general outline of a functional flow of an operation for correcting the deviation of shooting positions of liquid droplets, respectively.

Figure 9:
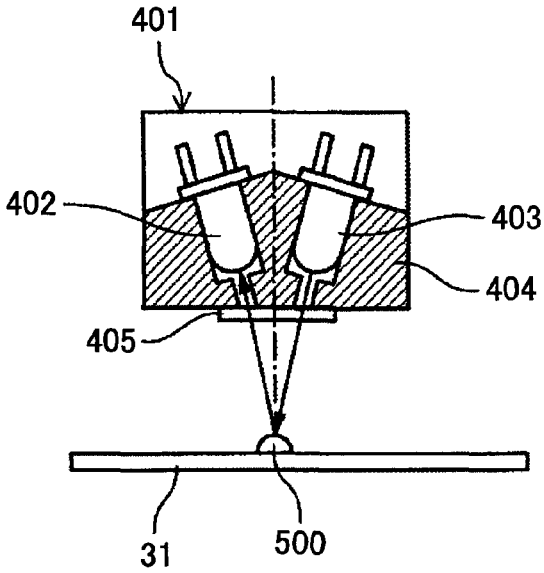
FIG. 9 is a diagram showing a pattern scanning sensor.

First, as shown in FIGS. 7 and 9, the carriage 23 is provided with a pattern scanning sensor 401 that detects an adjustment pattern (DRESS pattern, test pattern, and detection pattern) 400 formed on the conveying belt 31 as a water-repellent member. The pattern scanning sensor 401 holds in a holder 404 the light emitting element 402 as the light emitting section for emitting light to the adjustment pattern 400 on a water-repellent conveying belt 31 and the light receiving element 403 as the light receiving section for receiving the regular reflection light from the adjustment pattern 400, both of which are arranged in a direction orthogonal to the main scanning direction. Note that a lens 405 is provided at an emitting part and an incident part of the holder 404.

As shown in FIG. 2, the light emitting element 402 and the light receiving element 403 in the pattern scanning sensor 401 are arranged in a direction orthogonal to the scanning direction of the carriage 23. Accordingly, it is possible to reduce the influence on detection results due to a variation in the moving speed of the carriage 23. Furthermore, a relatively simple and inexpensive light source such as an infrared range like a LED and visible light can be used as the light emitting element 402. Since the spot diameter (detection range or detection area) of a light source uses an inexpensive lens instead of a high accuracy lens, a millimeter order of detection range is achieved.

When instructions for correcting the deviation of shooting positions are issued, an adjustment pattern formation/scanning controlling section 501 causes the carriage 23 to scan in a reciprocating manner in the main scanning direction relative to the conveying belt 31. At the same time, the adjustment pattern formation/scanning controlling section 501 causes the recording head 24 as liquid droplet ejection section to eject liquid droplets through a liquid droplet ejection controlling section 502 to form an adjustment pattern 400 (400B1, 400B2, 400C1, and 400C2) composed of a line-shaped reference pattern and a pattern to be measured formed of plural independent liquid droplets 500. Note that the adjustment pattern formation/scanning controlling section 501 is composed of the CPU 301 of the main controlling section 310 or the like.

Furthermore, the adjustment pattern formation/scanning controlling section 501 scans the adjustment pattern 400 formed on the conveying belt 31 with the pattern scanning sensor 401. The adjustment pattern scanning control is performed by driving the light emitting element 402 of the pattern scanning sensor 401 to emit light, while moving the carriage 23 in the main scanning direction. Specifically, as shown in FIG. 7, a PWM value for driving the light emitting element 402 of the pattern scanning sensor 401 is set in a light emitting controlling section 511 by the CPU 301 of the main controlling section 310, and the output of light emitting controlling section 511 is smoothed by a smoothing circuit 512 so as to be supplied to a driving circuit 513. Accordingly, the driving circuit 513 drives the light emitting element 402 to emit light, so that the light emitted from the light emitting element 402 is applied to the adjustment pattern 400 on the conveying belt 31.

In the pattern scanning sensor 401, as the light emitted from the light emitting element 402 is applied to the adjustment pattern 400 on the conveying belt 31, the regular reflection light reflected from the adjustment pattern 400 is incident on the light receiving element 403 and a detection signal corresponding to a light receiving amount of the regular reflection light from the adjustment pattern 400 is output from the light receiving element 403 so as to be input to a section 503 for calculating the deviation amount of shooting positions of shooting position correcting section 505. Specifically, as shown in FIG. 7, the output signal from the light receiving element 403 of the pattern scanning sensor 401 is photoelectrically converted by a photoelectric conversion circuit 521 included (not shown in FIG. 5) in the main controlling section 310, the photoelectrically-converted signal (sensor output voltage) is A/D converted by an A/D conversion circuit 523 after eliminating its noise component by a low pass filter circuit 522, and the A/D converted sensor output voltage data are stored in a common memory 525 by a signal processing circuit (DSP) 524.

The section 503 for calculating the deviation amount of shooting positions of the shooting position correcting section 505 detects the position of the adjustment pattern 400 based on the output results from the light receiving element 403 of the pattern scanning sensor 401 to calculate the deviation amount (deviation amount of shooting positions of liquid droplets) relative to the reference position. The shooting position deviation amount calculated by the section 503 for calculating the deviation amount of shooting positions is supplied to a section 504 for calculating a correction amount of ejection timing 504. The section 504 calculates the correction amount of ejection timing when the liquid droplet ejection controlling section 502 drives the recording head 24 so as to eliminate the deviation amount of shooting positions and sets the calculated ejection timing correction amount to the liquid droplet ejection controlling section 502. Accordingly, the liquid droplet ejection controlling section 502 drives the recording head 24 after correcting the ejection timing based on the correction amount. As a result, the deviation amount of shooting positions of liquid droplets is reduced.

Specifically, as shown in FIG. 7, the processing algorithm 526 executed by the CPU 301 detects the central position (point A) of the adjustment pattern 400 (one line pattern is referred to as "400*a*") from a sensor output voltage So stored in the common memory 525 as indicated by an arrow in FIG. 7A, calculates the deviation amount of actual shooting positions by the head 24 relative to the reference position (reference head), calculates the correction amount of print ejection timing from the deviation amount, and sets the correction amount in ejection controlling section 502.

Figure 10:
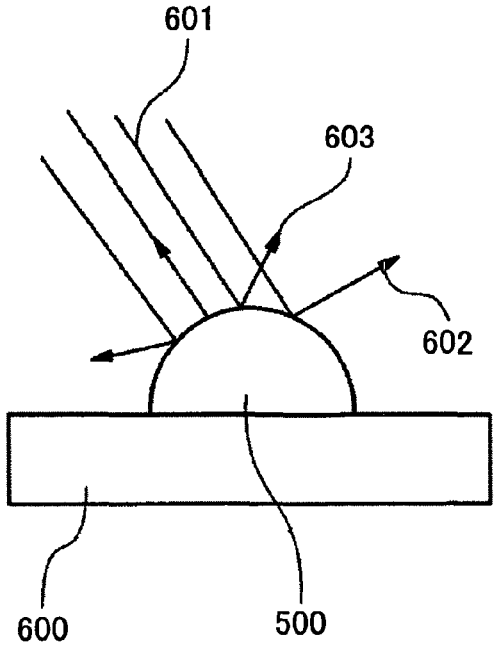
FIG. 10 is a diagram showing where the light from a liquid droplet is diffused.

Referring also to FIG. 10 and the subsequent drawings, a description is now made of the adjustment pattern 400 according to the embodiment of the present invention.

First, the principle of detecting shooting positions (pattern detection) according to the embodiment of the present invention is described. FIG. 10 shows where the light from a liquid droplet is diffused when it is incident on the liquid droplet (hereinafter referred to as an "ink droplet").

Figure 11:
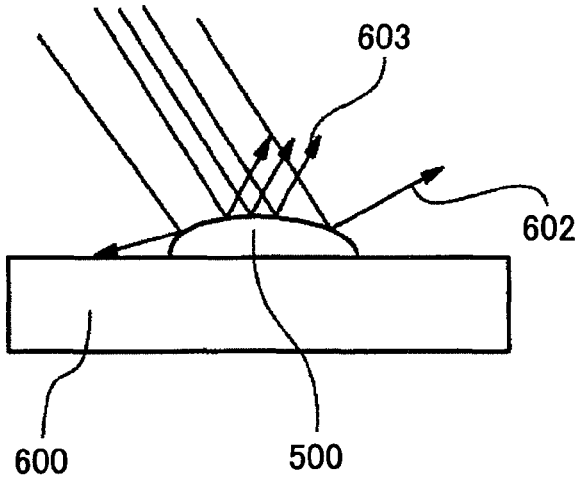
FIG. 11 is a diagram showing where light is diffused from a liquid droplet whose surface becomes flat.
Figure 12:
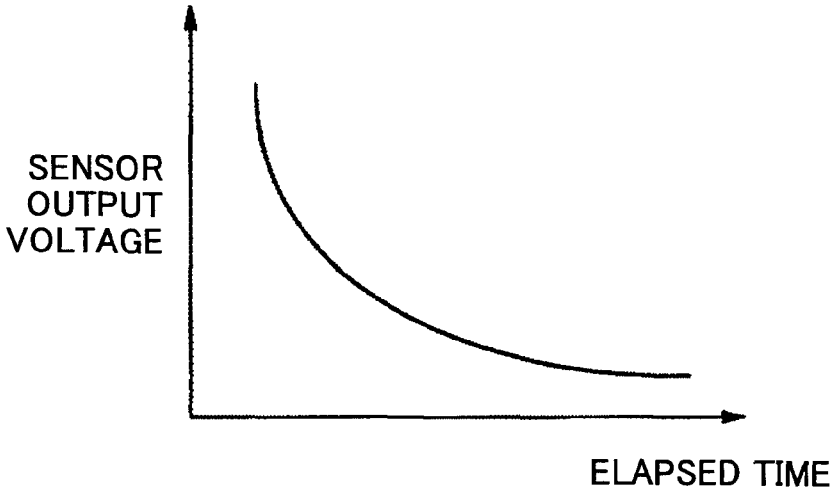
FIG. 12 is a diagram showing the relationship between elapsed time and a sensor output voltage after liquid droplets are shot.

As shown in FIG. 10, when light 601 is incident on an ink droplet 500 (the ink droplet 500 has a semi-spherical shape after impact) shot onto a member 600, most of the incident light 601 turns into diffused reflection light 602 and only a small amount of regular reflection light 603 is detected because the ink droplet 500 has a curved gloss surface. However, as shown in FIG. 11, the gloss will be lost from the surface and the semispherical shape of the ink droplet 500 will be gradually changed to a flattened shape with time. Therefore, the range and proportion of generating the regular reflection light 603 become relatively large compared with the diffused reflection light 602. Accordingly, as shown in FIG. 12, when the regular reflection light 603 is received by the light receiving element 403, sensor output voltage is lowered and detection accuracy is reduced with time.

Referring next to FIG. 13, a description is made of the position detection of the ink droplet 500 constituting the adjustment pattern 400 (exactly, a pattern 400*a*).

Assume that the surface (belt surface) of the conveying belt 31 has a gloss finish, thus making regular reflection light easily returned when the light from the light emitting element 402 is applied. Therefore, in FIG. 13B, most of the incident light 601 from the light emitting element 402 is regularly reflected at the surface areas of the conveying belt 31 where no ink droplets 500 are shot, resulting in the increased amount of the regular reflection light 603. Accordingly, as shown in FIG. 13A, the output (sensor output voltage) of the light receiving element 403 that receives the regular reflection light 603 becomes relatively large.

Figures 13A, 13B:
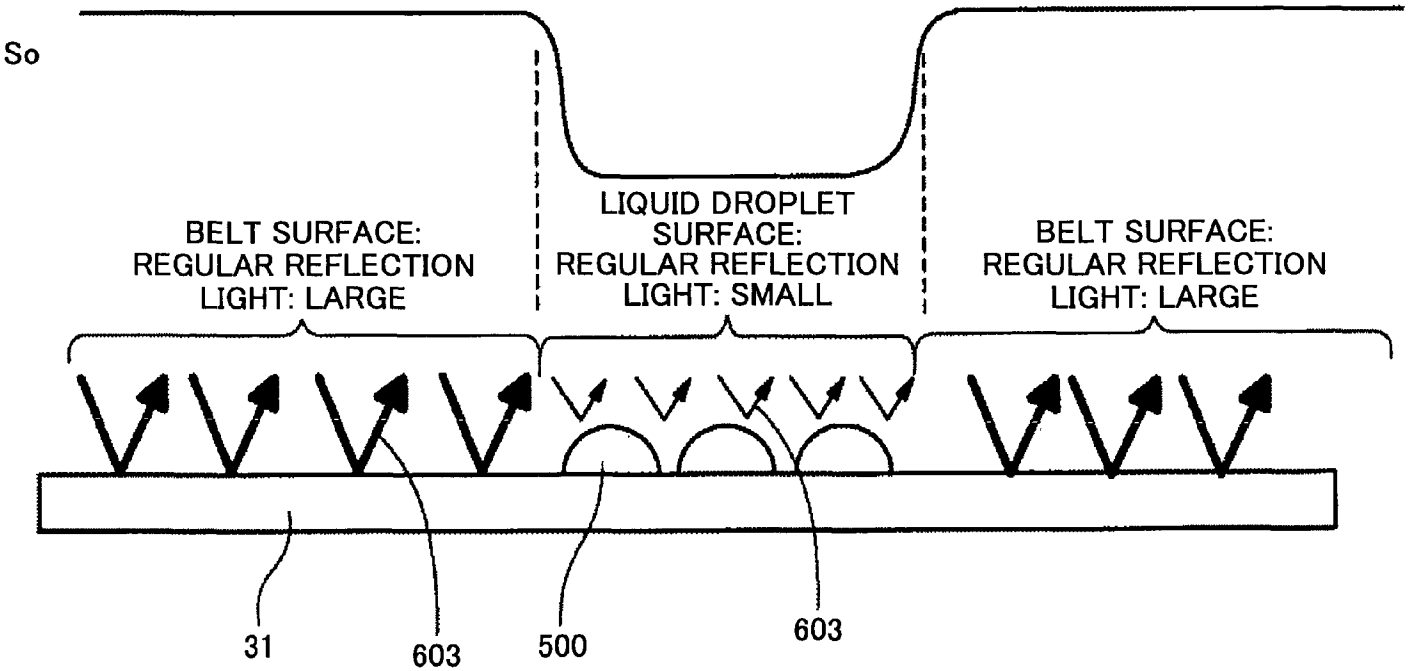
FIGS. 13A and 13B are schematic diagrams for explaining the adjustment pattern according the embodiment of the present invention.

On the other hand, in FIG. 13B, the incident light is diffused at the surfaces of the semi-spherical and glossy ink droplets 500 at the area where the ink droplets 500 are shot in an independent and a dense manner, resulting in the reduced amount of the regular reflection light 603. Accordingly, as shown in FIG. 13A, the output (sensor output voltage) of the light receiving element 403 that receives the regular reflection light 603 becomes relatively small. Note that the "dense manner" refers to where the areas between the ink droplets 500 are smaller than the areas (ink adhering areas) where the ink droplets 500 are shot in a predetermined detection range.

Figures 14A, 14B:
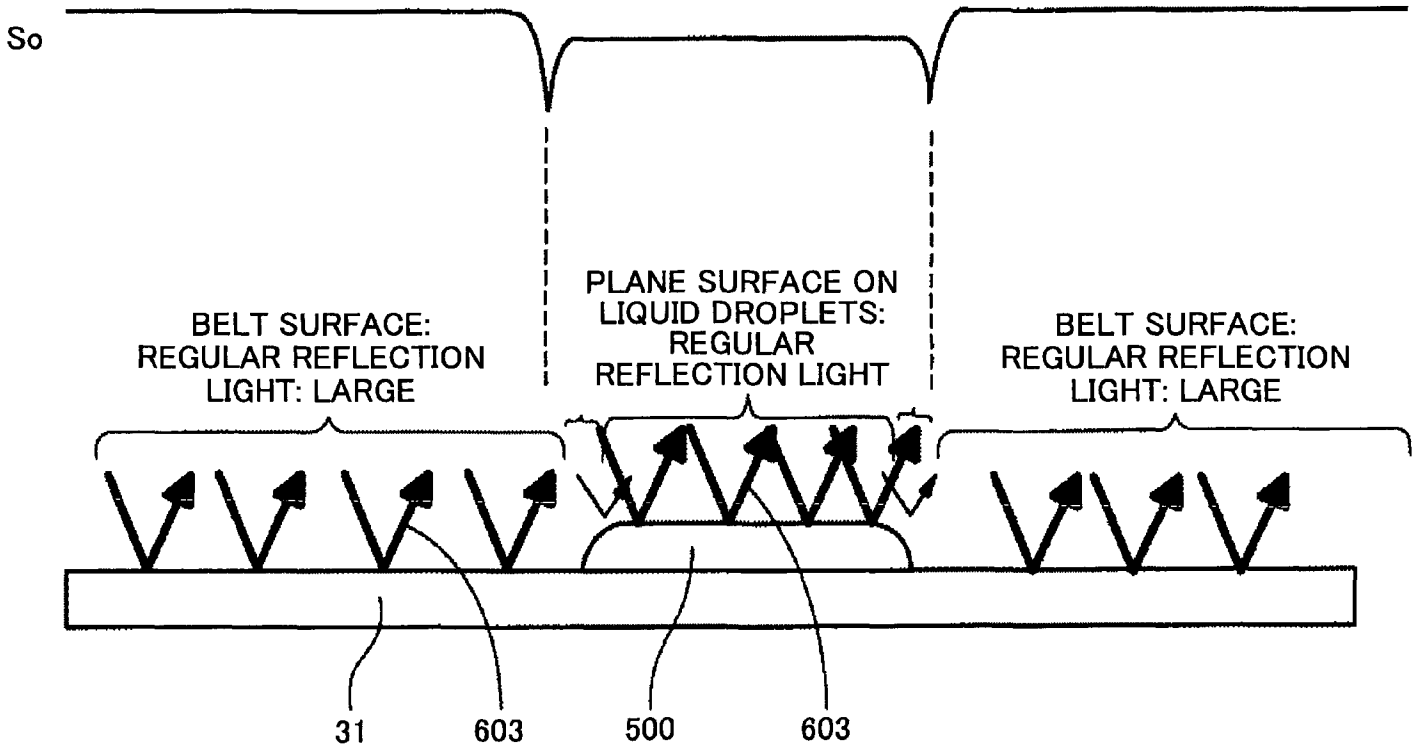
FIGS. 14A and 14B are schematic diagrams for explaining the adjustment pattern according a modified embodiment of the present invention.

Conversely, as shown in FIG. 14B, when the adjacent ink droplets come in contact and are connected with each other on the conveying belt 31, the top surfaces of the connected ink droplets 500 become flat, resulting in the increased amount of the regular reflection light 603. Accordingly, as shown in FIG. 14A, the sensor output voltage becomes substantially the same as that of the surface of the conveying belt 31, thereby making it difficult to detect the positions of the ink droplets 500. Note that even if the ink droplets are connected with each other, diffused light is caused to be generated between the ends of the connected ink droplets. However, it is difficult to detect the generated areas of diffused light because they are extremely limited. If it is attempted to detect them, the areas (ranges to be detected) viewed by the light receiving element 403 must be narrowed down. In this case, there is a possibility of reacting with noise factors such as a very small flaw or dust on the surface of the light receiving element 403, resulting in degraded detection accuracy and reliability of detection results.

Accordingly, it becomes possible to detect the shooting positions of the ink droplets by discriminating the part where the regular reflection light is attenuated among the outputs of the light receiving element 403 that receives the regular reflection light from the ink droplets. In order to detect the shooting positions of the ink droplets with high accuracy, the adjustment pattern 400 is necessarily composed of plural independent liquid droplets and be disposed in a dense manner (the areas between liquid droplets are smaller than the adhering areas of the liquid droplets in a detection range). Thanks to such an adjustment pattern, a simple configuration of the light emitting element 402 and the light receiving element 403 makes it possible to detect the adjustment pattern (shooting positions of liquid droplets) with high accuracy.

Figure 15:
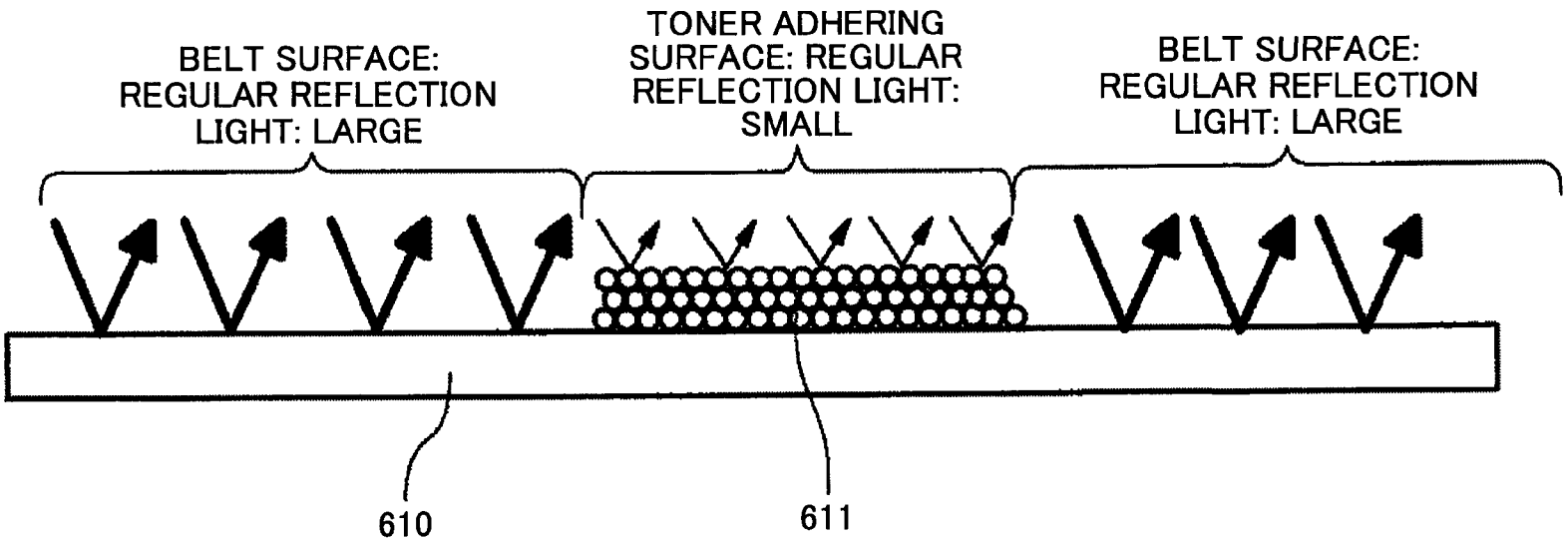
FIG. 15 is a schematic diagram for explaining a case where toner is used for comparison.

Referring also to FIG. 15, a description is now made of a difference between toner according to the electrophotographic method and liquid droplets according to the liquid droplet ejection method.

The toner according to the electrophotographic method maintains its shape even where it adheres onto a member to be stuck. Therefore, as shown in FIG. 15, even if toner particles 611 constituting the adjustment pattern are formed on a member 610 to be stuck in an overlapped manner, the amount of the regular reflection light at the toner adhering surface becomes smaller than that of the regular reflection light at the member 610 to be stuck. Accordingly, it is possible to detect the adjustment pattern with the output of the light receiving element 403 that receives the regular reflection light.

Conversely, as described above, when the adjacent liquid droplets are connected with each other after being shot onto the member 610, the top surfaces of the liquid droplets become flat. Substantially, the regular reflection light equivalent to the surface of the member 610 is caused to be generated. Even if a configuration of detecting the adjustment pattern with the change of the received amount of the regular reflection light from the adjustment pattern is merely adopted without understanding the characteristics of the liquid droplets, detection accuracy may be remarkably degraded. Particularly, when the ink droplets are shot onto a medium into which ink is permeated as in a medium to be recorded on so as to form the adjustment pattern, the pattern cannot be detected accurately.

In view of such characteristics of the liquid droplets, the present invention forms, on a water-repellent belt 31 as a member on which the adjustment pattern is formed, the adjustment pattern composed of plural independent liquid droplets where the areas between the liquid droplets are smaller than the adhering areas of the liquid droplets in the detection range. It is thereby possible to detect the adjustment pattern with the change of the received amount of the regular reflection light from the adjustment pattern with high accuracy. As a result, the deviation of the shooting positions of liquid droplets can be adjusted (corrected) with high accuracy.

Referring next to FIGS. 16 through 18, a description is made of another example of a position detection process (scanning process) for the adjustment pattern 400 formed on the conveying belt 31.

Figure 16A:
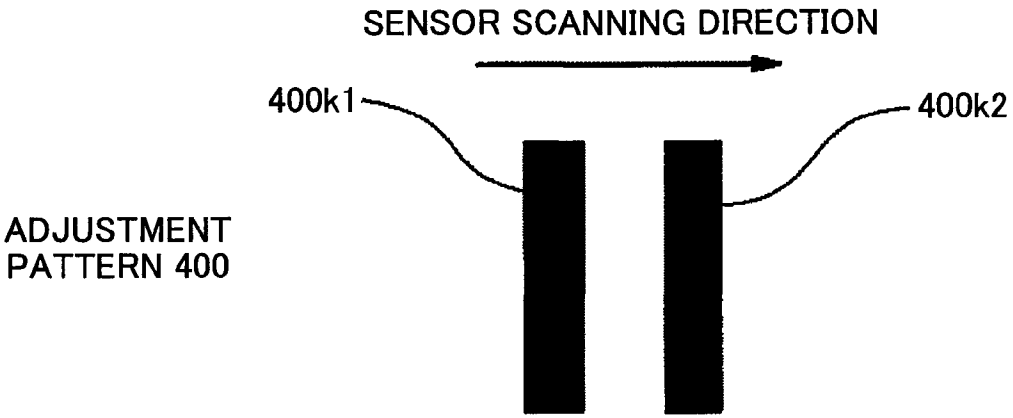
FIGS. 16A and 16B are diagrams for explaining a first example of a process for detecting the position of the adjustment pattern.
Figure 16B:
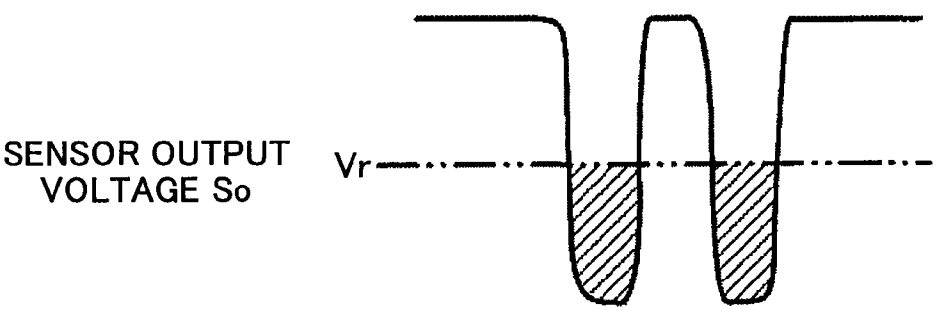

As a first example shown in FIG. 16A, a line-shaped pattern 400*k*1 (serving as the reference pattern) and a line-shaped pattern 400*k*2 (serving as the pattern to be measured) are formed on the conveying belt 31, for example, by recording heads 24*k*1 and 24*k*2, respectively. These patterns are scanned by the pattern scanning sensor 401 in the sensor scanning direction (carriage main scanning direction). Accordingly, as shown in FIG. 16B, the sensor output voltage So that falls at the patterns 400*k*1 and 400*k*2 is obtained from the output results of the light receiving element 403 of the pattern scanning sensor 401.

Here, when the sensor output voltage So and a previously set threshold Vr are compared with each other, it is possible to detect positions, at which the sensor output voltage So falls below the threshold Vr, as the edges of the patterns 400*k*1 and 400*k*2. At this time, the centers of gravity of the areas (parts indicated by oblique lines in FIG. 16B) encircled by the threshold Vr and the sensor output voltage So are calculated to be set as the centers of the patterns 400*k*1 and 400*k*2, respectively. Accordingly, it is possible to reduce an error caused by a small fluctuation of the sensor output voltage by using the centers of gravity of the areas.

Figure 17A:
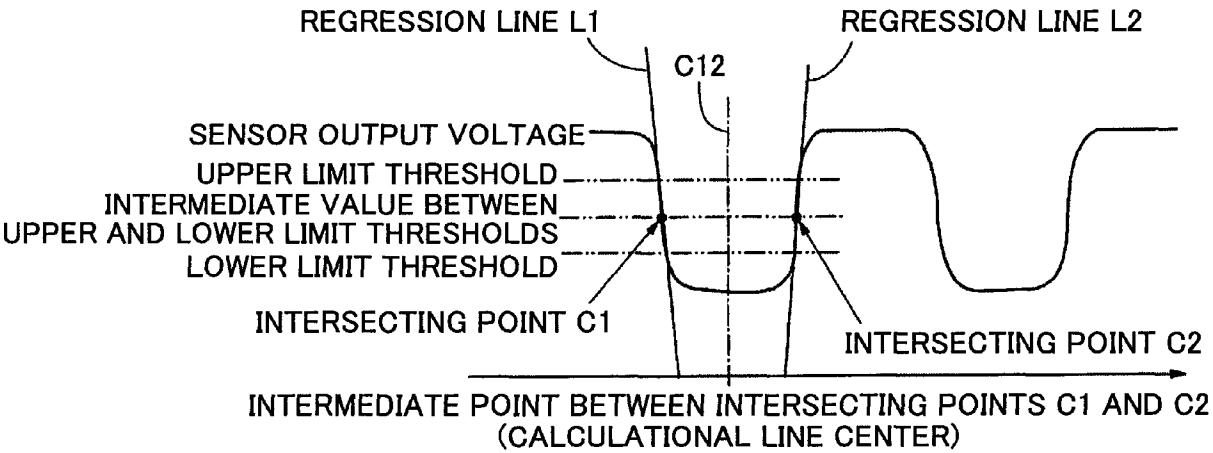
FIGS. 17A and 17B are diagrams for explaining a second example of a process for detecting the position of the adjustment pattern.
Figure 17B:
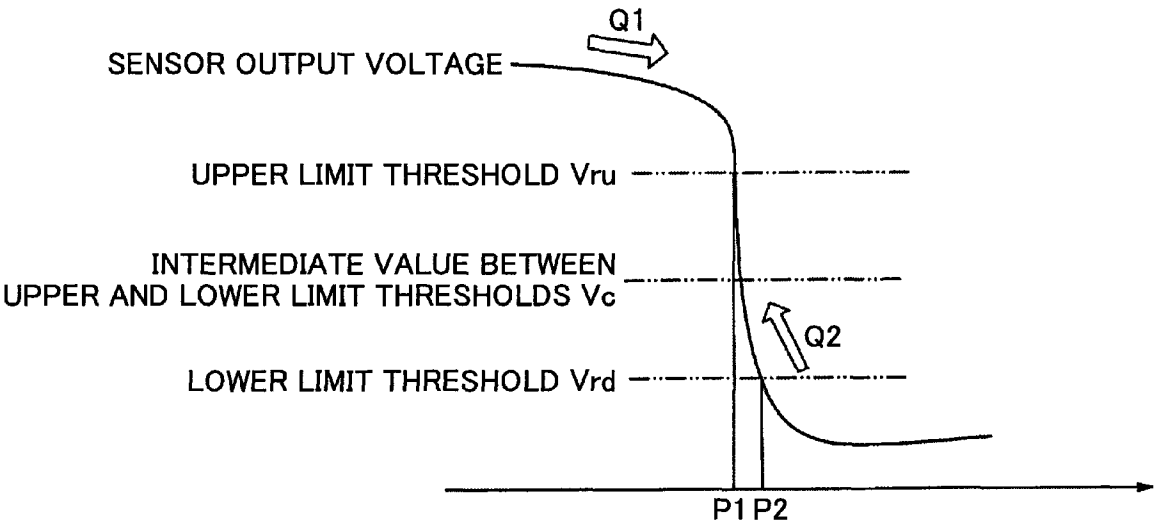

As a second example shown in FIGS. 17A and 17B, the patterns 400*k*1 and 400*k*2 equivalent to those of the first example are scanned by the pattern scanning sensor 401 to obtain the sensor output voltage So as shown in FIG. 17A. FIG. 17B shows where the falling part of the sensor output voltage So is enlarged.

Here, the falling part of the sensor output voltage So is searched in the direction of an arrow Q1 in FIG. 17B, and the point at which the sensor output voltage So falls below (becomes smaller than equal to) the lower limit threshold Vrd is stored as the point P2. Next, the sensor output voltage So is searched from the point P2 in the direction of an arrow Q2, and the point at which the sensor output voltage So exceeds the upper limit threshold Vru is stored as the point P1. Then, the regression line L1 is calculated from the output voltage So between the points P1 and P2, and the intersecting point between the regression line L1 and the intermediate value Vrc between the upper and lower limit thresholds is calculated using the obtained regression line and set as the intersecting point C1. Similarly, the regression line L2 is calculated with respect to the rising part of the sensor output voltage So, and the intersecting point between the regression line L2 and the intermediate value Vrc between the upper and lower limit thresholds is calculated and set as the intersecting point C2. Accordingly, the line center C12 is referred to based on the equation (intersecting point C1+intersecting point C2/2) using the intermediate point between the intersecting points C1 and C2.

Figures 18A, 18B:
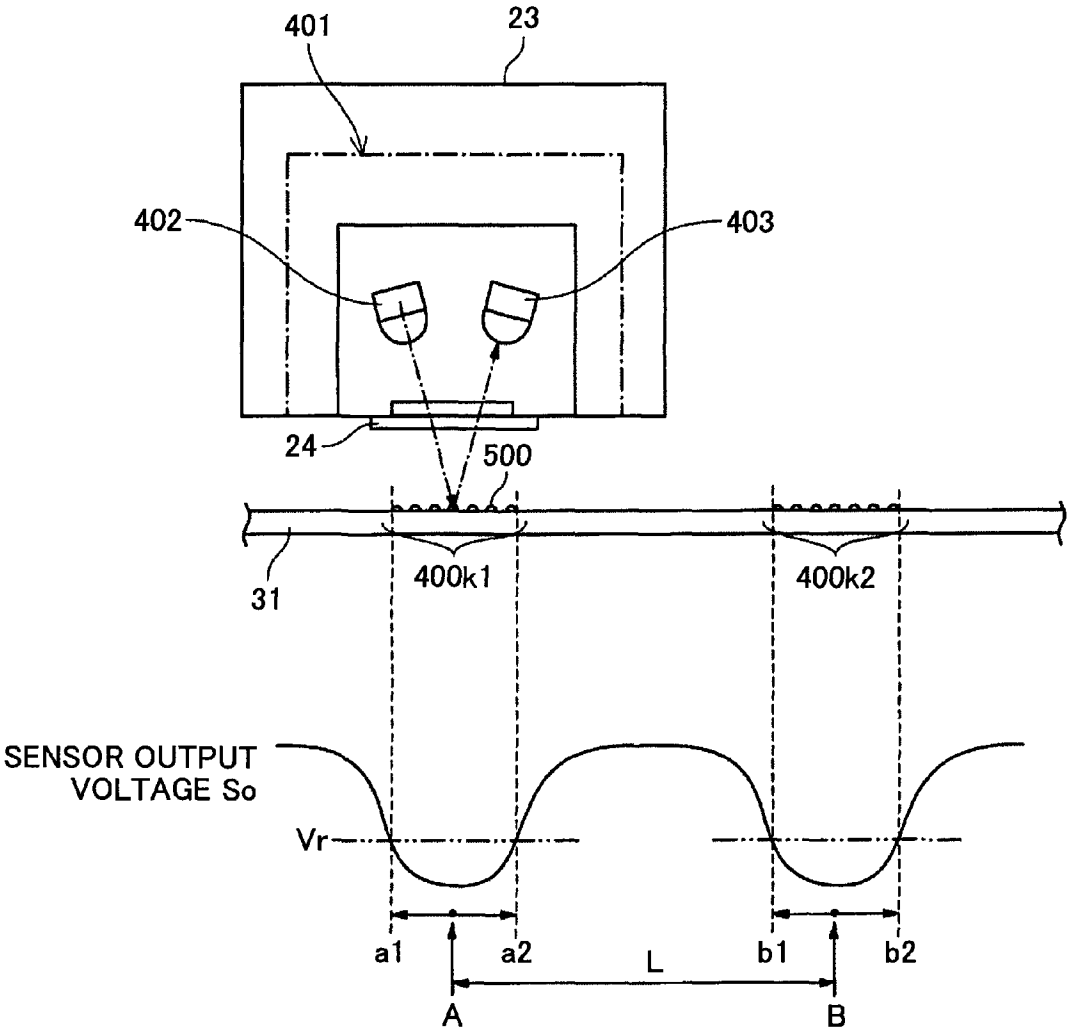
FIGS. 18A and 18B are diagrams for explaining a third example of a process for detecting the position of the adjustment pattern.

As a third example shown in FIG. 18A, the line-shaped pattern 400*k*1 and the line-shaped pattern 400*k*2 are formed on the conveying belt 31, for example, with the recording heads 24*k*1 and 24*k*2, respectively, in the same manner as that of the first example. These patterns are scanned by the pattern scanning sensor 401 in the sensor scanning direction. Accordingly, the sensor output voltage (photoelectric conversion output voltage) So as shown in FIG. 18B is obtained.

Here, with the algorithm 526 described above, higher harmonic wave noise is eliminated with an IIR filter, the quality of a detection signal is evaluated (the presence or absence of lacking, instability, and surplus), and an inclined part near the threshold Vr is detected so as to calculate a regression curve. Then, the intersecting points a1, a2, b1, and b2 between the regression curve and the threshold Vr are calculated (actually computed with a position counter composed of an application specific integrated circuit (ASIC)), the intermediate point A between the points a1 and a2 and the intermediate point B between the points b1 and b2 are calculated, and the distance L between the intermediate points A and B is calculated. Accordingly, the intermediate point between the patterns 400*k*1 and 400*k*2 is detected.

After the detection of the intermediate points, the difference (ideal distance between the recording heads−L) between an ideal distance from the recording head 24*k*1 to the recording head 24*k*2 and the calculated distance L is computed. This difference is equivalent to a deviation amount in actual printing. Then, a correction value for correcting timing of ejecting liquid droplets (liquid droplet ejection timing) from the recording heads 24*k*1 and 24*k*2 is calculated based on the obtained deviation amount, and the corrected value is set in the liquid droplet ejection controlling section 502. Accordingly, the liquid droplet ejection controlling section 502 drives the recording heads at the corrected liquid droplet ejection timing, thereby leading to the reduction of the position deviation.

Figure 19:
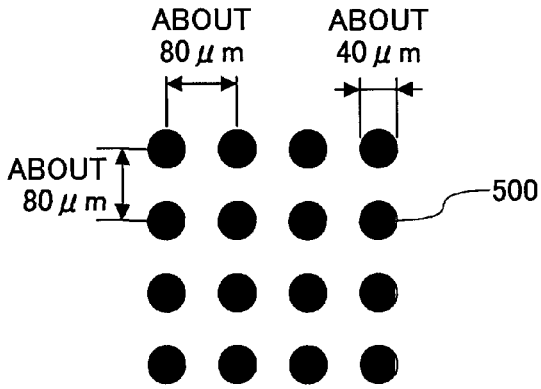
FIG. 19 is a diagram for explaining as a first example the shape of liquid droplets forming the adjustment pattern in their shot states.

Referring next to FIGS. 19 through 21, a description is made of examples of different shapes of ink droplets forming the adjustment pattern 400 in their shot modes.

FIG. 19 shows a first example in which plural of the liquid droplets 500 are independently arranged in a grid pattern.

Figure 20A:
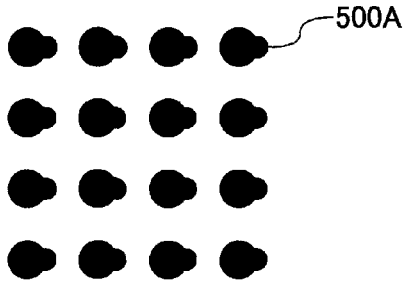
FIGS. 20A and 20B are diagrams for explaining as a second example the shape of liquid droplets forming the adjustment pattern in their shot states.
Figure 20B:
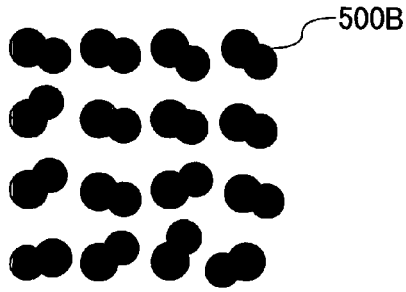

FIG. 20A shows a second example in which hourglass-shaped liquid droplets 500A, each group composed of a large droplet (e.g., a main droplet) and a small droplet (e.g., a satellite droplet or a small droplet), are independently arranged in a grid pattern. FIG. 20B shows another second example in which liquid droplets 500B, each composed of two liquid droplets substantially the same in size, are independently arranged.

Figure 21A:
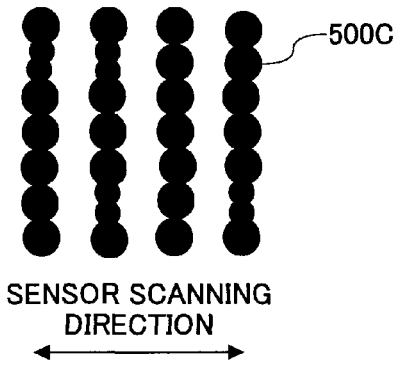
FIGS. 21A and 21B are diagrams for explaining as a third example the shape of liquid droplets forming the adjustment pattern in their shot states.
Figure 21B:
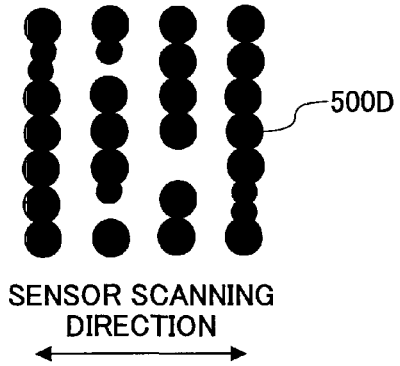

FIG. 21A shows a third example in which plural liquid droplets 500C, each group composed of multiple liquid droplets linearly and sequentially combined with each other in a direction orthogonal to the scanning direction by the pattern scanning sensor 401, are arranged in the sensor scanning direction. FIG. 21B shows another third example in which plural liquid droplets 500D, each group forming a partially-lacking line segment (which may be the same or different in length) composed of multiple liquid droplets as in FIG. 21A, are arranged in the sensor scanning direction.

Figure 22A:
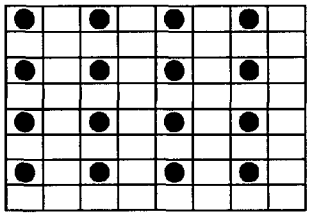
FIGS. 22A through 22C are diagrams for explaining different types of arrangement patterns of liquid droplets forming the adjustment pattern.
Figure 22B:
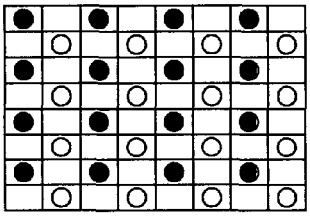
Figure 22C:
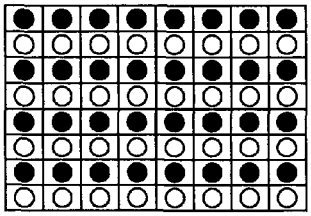
Figure 23:
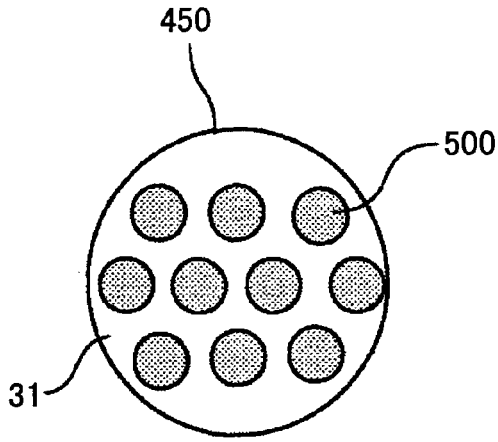
FIG. 23 is a diagram for explaining the contact areas of liquid droplets in a detection range.

Referring next to FIGS. 22 and 23, a description is made of a configuration of improving accuracy in detecting shooting positions.

First, the proportion of diffused reflection light to the reflection light from the adjustment pattern 400 is set to be constant. In other words, as in the case of the shot ink droplets shown in the central part of FIG. 13B, the liquid droplets 500 are shot so that the diffusion of the reflection light from the adjustment pattern 400 is uniform. Accordingly, high reproducibility of the sensor output voltage (detection potential) applied to the processing algorithm is obtained, thereby making it possible to detect the adjustment pattern 400 (shooting positions of liquid droplets) with high accuracy so as to perform a highly-accurate deviation adjustment of the shooting positions of liquid droplets.

Here, in order to make uniform diffusion of the reflection light from the adjustment pattern 400, the areas of the surfaces from which diffused reflection light is emitted among the surfaces of ink droplets are made constant. For example, as shown in FIG. 22A, plural of the ink droplets 500 constituting the adjustment pattern 400 are independently arranged at intervals of one dot. At this time, the adjacent ink droplets regularly adhere onto the conveying belt 31 without being stuck and the areas of the surfaces from which diffused reflection light is emitted are made constant. Provided that the adjacent ink droplets are independent from one another without being stuck, the ink droplets 500 may be arranged in a staggered manner as shown in FIG. 22B or arranged in all dots as shown in FIG. 22C.

Furthermore, as shown in FIG. 12, the ink droplets are dried and the diffusion of reflection light is changed with time after the liquid droplets are shot. Therefore, the time until the pattern scanning sensor 401 receives regular reflection light after the shooting of the liquid droplets is made constant, thereby making it possible to ensure the reproducibility of the detection potential.

Furthermore, from the viewpoint of making the uniform diffusion of reflection light, each of the ink droplets 500 may be composed of two liquid droplets (e.g., a main droplet and a satellite droplet) in a combined manner and regularly arranged as shown in FIGS. 20A and 20B.

Furthermore, in order to make the uniform diffusion of the reflection light from the adjustment pattern 400, the contact areas of the ink droplets 500 and the conveying belt 31 in a detection range (detection area) 450 are made constant as shown in FIG. 23. For example, plural of the ink droplets 500 constituting the adjustment pattern 400 are independently arranged at intervals of one dot. The contact areas of the ink droplets 500 that adhere onto the surface of the conveying belt 31 are made constant under conditions where each of the liquid droplets 500 is independent and the ejection amounts of the ink droplets 500 are made the same. In this case also, the ink droplets 500 may be arranged in a staggered manner, provided that the adjacent ink droplets are independent from one another without being stuck. As a specific example, the contact areas can be easily kept constant with the combination of the conveying belt 31 made of a fluorine system resin (ETFE) and a pigment system ink, both having a water-repellent property.

Furthermore, the diffusion of the reflection light from the adjustment pattern is made further uniform with a synergy effect by making both the areas of the surfaces from which diffused reflection light is emitted among the surfaces of ink droplets constant and the contact areas of the ink droplets and the conveying belt constant. Accordingly it is possible to obtain the detection potential having high reproducibility.

Figure 24:
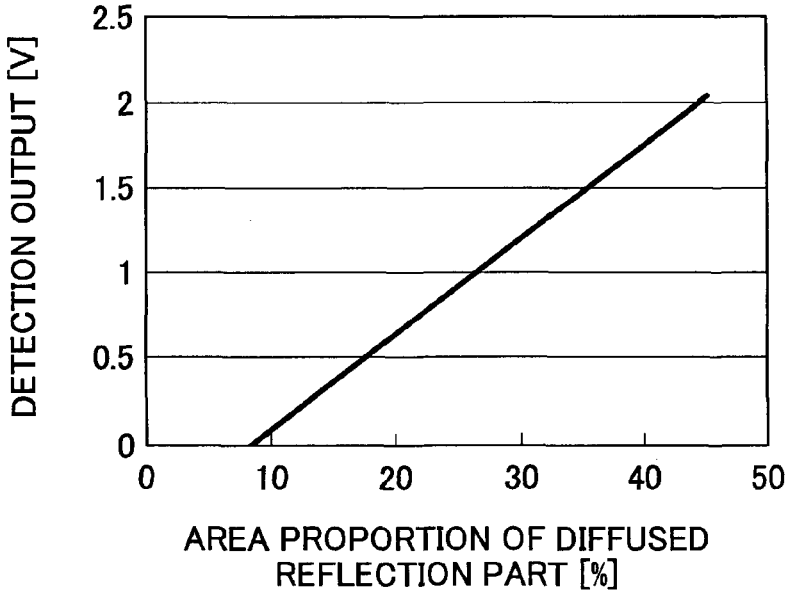
FIG. 24 is a diagram approximately showing an experimental result between the proportion of the areas of diffused reflection parts and a detection result.

Furthermore, it is necessary to take into consideration the fact that the output for detecting the presence or absence of the adjustment pattern 400 does not become large unless the ink droplets are densely arranged to some extent. In other words, when the correlation between the areas of the diffused reflection part of ink droplets and a detection output amount is experimentally confirmed, the relationship expressed by the approximate line as shown in FIG. 24 is provided. It shows that a desired detection output can be obtained if there is a 10% or more area of the diffused reflection part in the area of the adjustment pattern 400.

Next, a description is made of liquid droplets forming the adjustment pattern 400 in terms of the diffused reflection ratio of a pattern.

As shown in FIG. 23, the diffused reflection ratio of a pattern refers to the proportion of diffused reflection parts (parts from which diffused light is generated) in a detection range (detection area) with the pattern scanning sensor 401. In other words, the diffused reflection ratio of a pattern is a value obtained by dividing the sum of the areas of diffused reflection parts by the area of a detection range.

Figure 25:
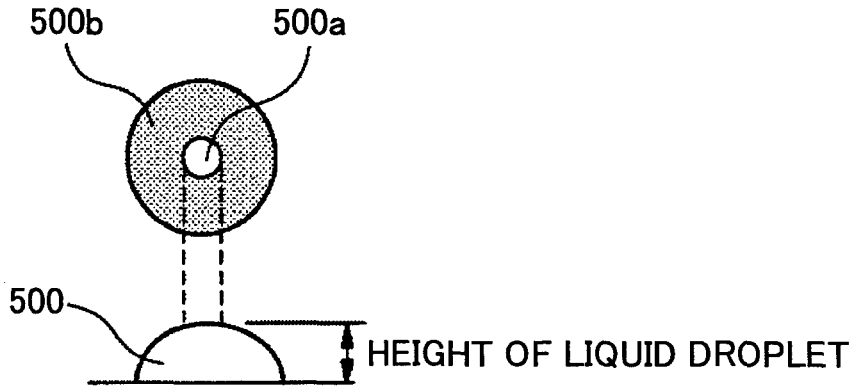
FIG. 25 is a schematic diagram of a liquid droplet for explaining the diffused reflection ratio of a pattern in a liquid droplet.
Figure 26:
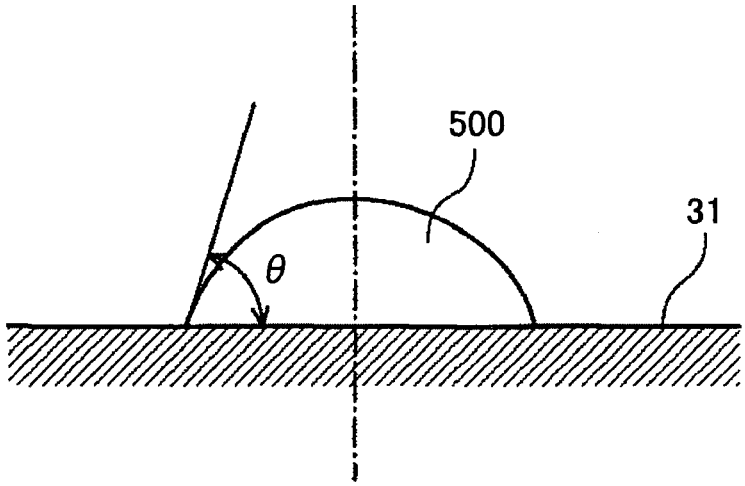
FIG. 26 is a diagram of the contact angle of a liquid droplet.

At this time, the diffused reflection ratio of a pattern can be improved by increasing the areas of diffused reflection parts if the detection range is constant. In the diffused reflection parts, if the ink droplets 500 adhering onto the surface of the conveying belt 31 have poor wettability (a large contact angle θ as shown in FIG. 26) as shown in FIG. 25, they are formed into a semi-spherical shape. In this case, on the outer peripheral surfaces of the ink droplets 500, there are parts 500*a* and 500*b* at which unidirectional light is regularly reflected and diffusely reflected, respectively. It is possible to handle the diffused reflection parts by controlling the ejection of ink droplets so that each of the ink droplets 500 has the part 500*b* at which unidirectional light is diffusely reflected (the diffused reflection ratio of droplets) in large amounts.

Here, the diffused reflection ratio of droplets refers to the proportion of diffused reflection parts to the contact area of a belt surface, and it is a value obtained by dividing the areas of diffused reflection parts per droplet by the contact areas of the diffused reflection parts with the belt surface.

Specifically, liquid droplets for use in forming the adjustment pattern 500 are preferably the largest ones in the ejection amount (droplet volume) among liquid droplets for use in forming images. In other words, liquid droplets are ejected in a print mode where the largest droplets are ejected so as to form the adjustment pattern 400. Accordingly, the heights of the liquid droplets 500 shown in FIG. 25 become greater and the reflection ratio of droplets thereof is improved.

Furthermore, since the composition of ink is different for each color (cyan, magenta, yellow, and black), the shapes of the liquid droplets 500 may be different from one another. Therefore, it is possible to improve the reflection ratio of droplets by ejecting liquid droplets by an amount corresponding to the colors of the liquid droplets to be ejected.

As described above, the image forming apparatus according to the embodiment of the present invention has the liquid droplet ejection section (recording head 24) that ejects liquid droplets; the water-repellent belt that receives liquid droplets; the section for forming the adjustment pattern composed of plural independent liquid droplets for detecting the shooting positions of liquid droplets; the scanning section composed of the light emitting element 402 for emitting light to be applied to the adjustment pattern and the light receiving element 403 for receiving the regular reflection light of the light applied to the adjustment pattern; and the section for correcting the shooting positions of liquid droplets by calculating the deviation amount of the shooting positions based on the attenuated signal of the regular reflection light output from the scanning section. With this configuration, it is possible to increase the output sensitivity of the light receiving element 403 (sensor) and improve the detection performance for a deviation amount and scanning performance such as repeat accuracy by controlling the ejection of liquid droplets so that the diffused reflection ratio of patterns of liquid droplets constituting the adjustment pattern becomes maximum.

In this case, it is further possible to improve detection sensitivity and accuracy by controlling the liquid droplet ejection head 24 so that the areas of diffused reflection parts (the diffused reflection ratio of droplets) in independent liquid droplets become maximum. In order to control the liquid droplet ejection head 24 so that the areas of diffused reflection parts become maximum, it is preferable to (1) control the ejection amount of liquid droplets; (2) control the ejection amount of liquid droplets according to the colors of the liquid droplets; (3) control the liquid droplet ejection head 24 so that the time difference between the ejection of liquid droplets for forming a pattern and light emitting/receiving operations for scanning the pattern becomes minimum (in addition, control the liquid droplet ejection head 24 so that the ejection of liquid droplets and the light emitting/receiving operations are performed at the same time); (4) adopt a material in which the contact angle between a belt conveying surface and a liquid droplet is large; (5) form liquid droplets into a circular shape or a glass-hour shape when they are in contact with the belt conveying surface; (6) control the ejection of liquid droplets so that the areas of the liquid droplets become largest in a nearly independent manner in a range capable of being detected by the light emitting element 402 and the light receiving element 403 (e.g., control the arrangement of liquid droplets so that the intervals between the liquid droplets become minimum).

Next, a description is made of the formation and detection of the adjustment pattern 400. As described above, the shape of ink droplets is changed because their moisture is evaporated with time after the ink droplets adhere onto a belt surface, and regular reflection light increases with time immediately after the formation of the liquid droplets. This results in the reduced output voltage of the pattern scanning sensor 401.

Accordingly, in order to accurately detect the shooting positions of ink droplets, it is preferable to detect the adjustment pattern 400 with the pattern scanning sensor 401 immediately after the formation of the adjustment pattern 400. Now, the print speed for forming the adjustment pattern 400 and the scan speed for scanning the adjustment pattern 400 are set to be the same, so that the position of the adjustment pattern 400 is detected immediately after the execution of a printing operation. Therefore, it is necessary to provide the pattern scanning sensor 401 of the carriage 23 on the upstream side relative to the scanning direction for printing the adjustment pattern 400. Note, however, that this configuration can be applied only to either the forward or backward position detection.

Therefore, the print speed for forming the adjustment pattern 400 and the scan speed for scanning the adjustment speed 400 are set to be different from each other; the adjustment pattern 400 is printed on the belt surface in the forward and backward movements and successively detected without rotating the conveying belt 31. In this case, the pattern scanning sensor 401 is arranged so as to be positioned above the area where the adjustment pattern 400 is formed.

Referring now to FIGS. 27 through 30, a description is made of the reference pattern and the pattern to be measured constituting the adjustment pattern 400 according to the embodiment of the present invention.

Figure 27:
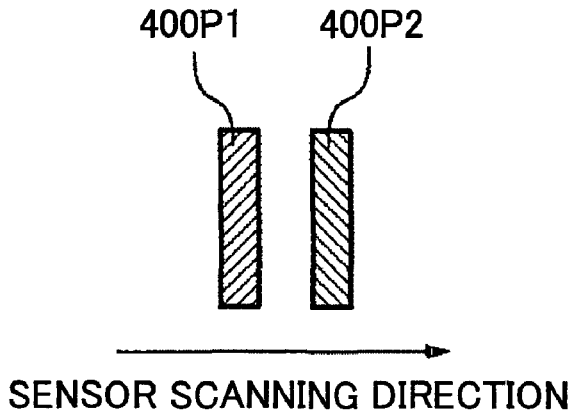
FIG. 27 is a diagram for explaining a reference pattern and a pattern to be measured constituting the adjustment pattern.

As shown in FIG. 27, in the adjustment pattern 400, the reference pattern 400P1 and the pattern 400P2 to be measured formed under an ejection condition different from the reference pattern P1 (one for each) are arranged in parallel so as not to be overlapped with each other in the scanning direction of the recording head 24. As described above, the distance between the reference pattern 400P1 and the pattern 400P2 to be measured is measured (calculated). Note that the scanning direction for printing the reference pattern with the recording head 24 may or may not correspond to the sensor scanning direction with the pattern scanning sensor 401. In addition, the scanning direction for printing the pattern to be measured may or may not correspond to the scanning direction for printing the reference pattern. The combination of one reference pattern and one pattern to be measured refers to the minimum unit of the adjustment pattern 400.

Figure 28:
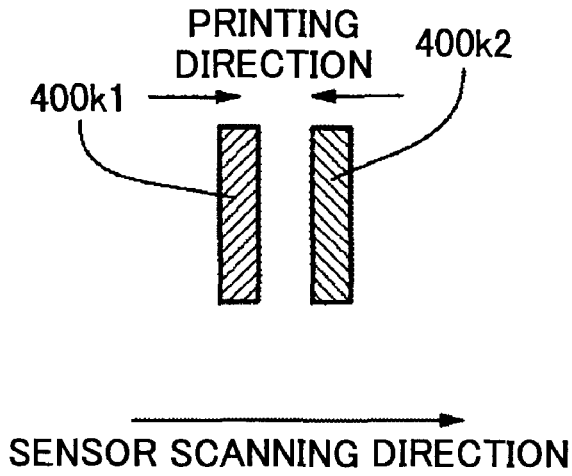
FIG. 28 is a diagram for explaining the adjustment pattern for adjusting the deviation of ruled lines.

For example, as shown in FIG. 28, in the case of using the recording head 24*k*1, the adjustment pattern for adjusting the deviation of ruled lines caused by the forward and backward scannings is composed of a pattern 400*k*1 formed by the forward printing and a pattern 400*k*2 formed by the backward printing, which are arranged in parallel to each other.

Figure 29:
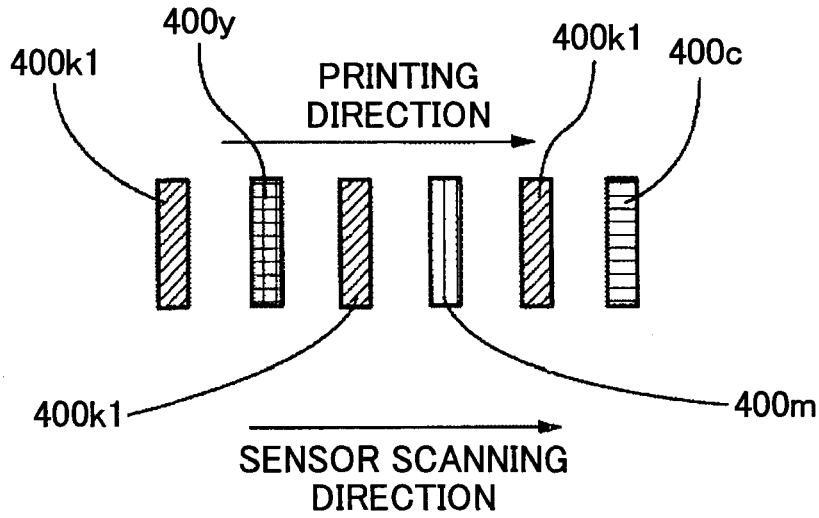
FIG. 29 is a diagram for explaining the adjustment pattern for adjusting the color shift.

Furthermore, as shown in FIG. 29, the adjustment pattern for adjusting the color shift caused by different colors of the recording heads 24 is composed of patterns 400*k*1 with the recording head 24*k*1 as the reference pattern and patterns 400*c*, 400*m*, and 400*y* with the recording heads 24*c*, 24*m*, and 24*y* as the pattern to be measured, which are alternately arranged adjacent each other. Note that the patterns 400*k*1 as the reference pattern are black here, but the color of the reference pattern may be any of C, M, and Y.

Figure 30:
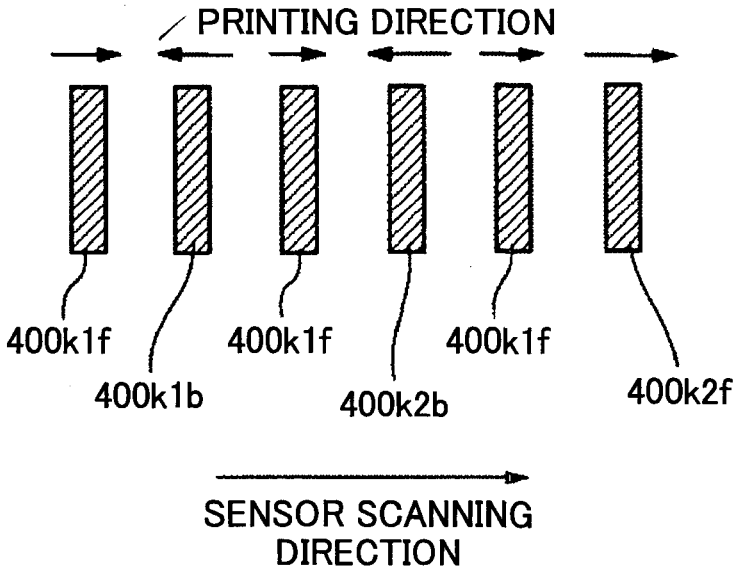
FIG. 30 is a diagram for explaining the adjustment pattern for adjusting the deviation of ruled lines in the case of using the recording heads that eject the same colors of liquid droplets.

Furthermore, as shown in FIG. 30, in the case of using the two recording heads 24*k*1 and 24*k*2 that eject the same color of liquid droplets as described above, the adjustment pattern is composed of patterns 400*k*1*f* formed in the forward printing with the recording head 24*k*1 as the reference pattern, a pattern 400*k*1*b* formed in the backward printing with the recording head 24*k*1, a pattern 400*k*2*f* formed in the forward printing with the recording heard 24*k*2, and a pattern 400*k*2*b* formed in the backward printing with the recording head 24*k*2 as the pattern to be measured, which are alternately arranged adjacent each other.

Figure 31:
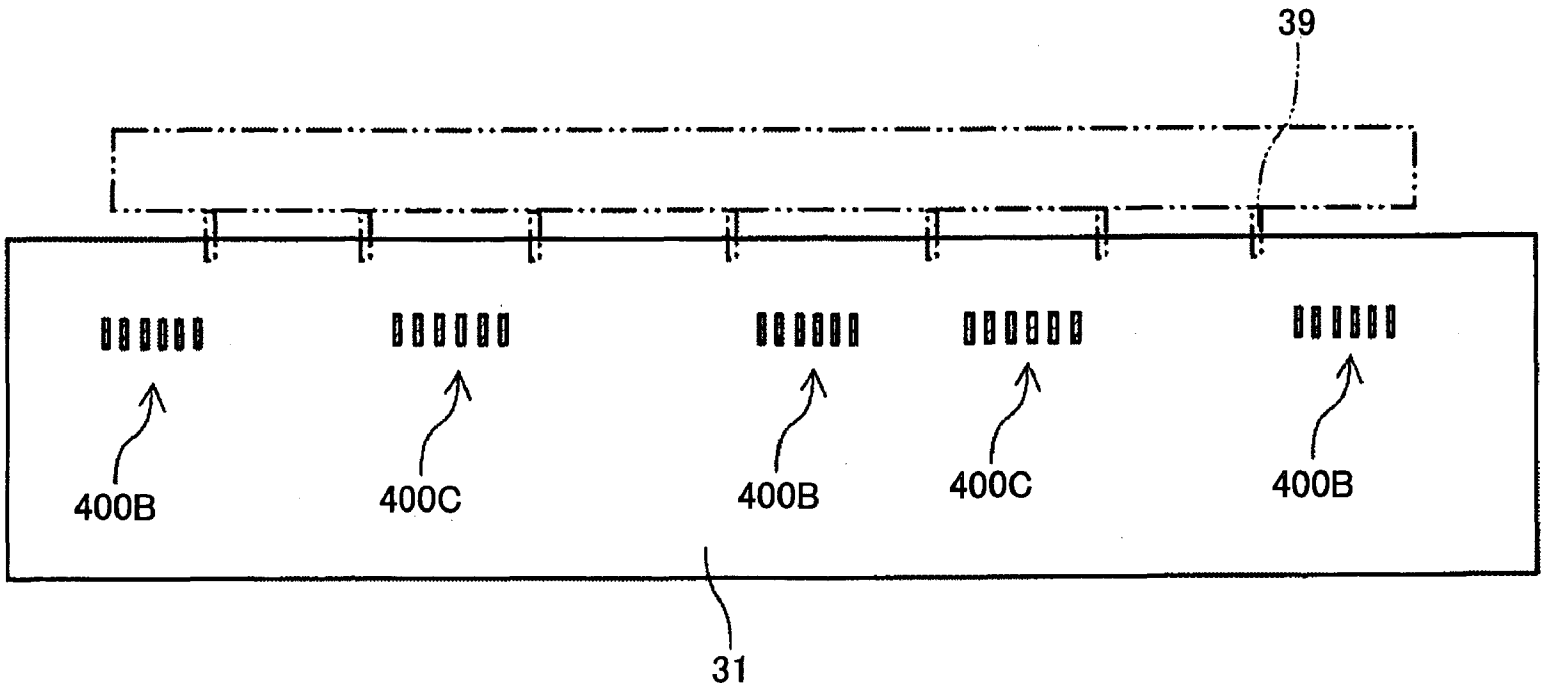
FIG. 31 is a diagram for explaining an arrangement example of the adjustment pattern.

As shown in FIG. 31, such adjustment patterns for adjusting the deviation of ruled lines and the color shift are formed on a carriage scanning line in plural blocks, thereby making it possible to form an integrated adjustment pattern for adjusting the deviation of ruled lines and the color shift. Needless to say, the adjustment pattern may be used not only for adjusting both the deviation of ruled lines and the color shift, but also for adjusting only the deviation of ruled lines or the color shift.

Figure 33:
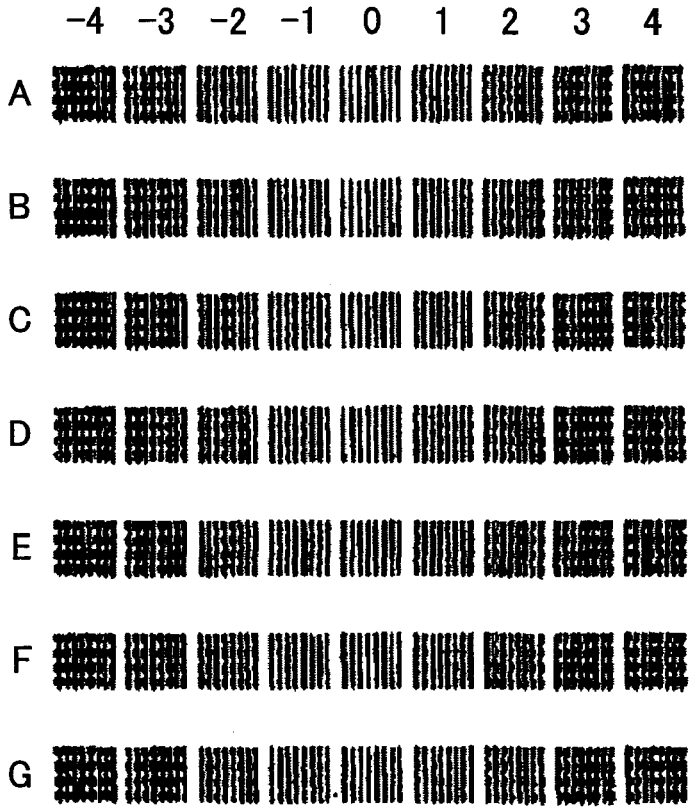
FIG. 33 is a diagram for explaining an example of a typical adjustment pattern.

Accordingly, unlike the typical pattern arrangement shown in FIG. 33, the integrated adjustment pattern has plural of the reference patterns and the patterns to be measured, which are alternately formed at substantially equal intervals.

Furthermore, as shown in FIG. 31, the patterns are preferably arranged at places other than the separating claw 39 that easily causes a flaw on the surface of the conveying belt 31. In other words, detection accuracy can be improved by preventing the patterns from being formed on the area where the surface property of a water-repellent member is changed. The example of FIG. 31 shows a case in which pattern blocks 400B for adjusting the deviation of ruled lines are formed at three parts in the main scanning direction and pattern blocks 400C for adjusting the color shift are formed at two parts in the main scanning direction (one set of pattern blocks is printed in the forward movement and the other set of pattern blocks is printed in the backward movement), while avoiding the area causing the change of a property. The pattern blocks (the combination of the reference patterns and the patterns to be measured) are formed at plural parts on the water-repellent member such as the conveying belt 31, and values for correcting the position deviation calculated for each block are averaged to correct the ejection timing. As a result, irregularities of correcting the position deviation at the position in the main scanning direction become inconspicuous, and printing is balanced as a whole for correcting a position deviation amount.

Figure 32:
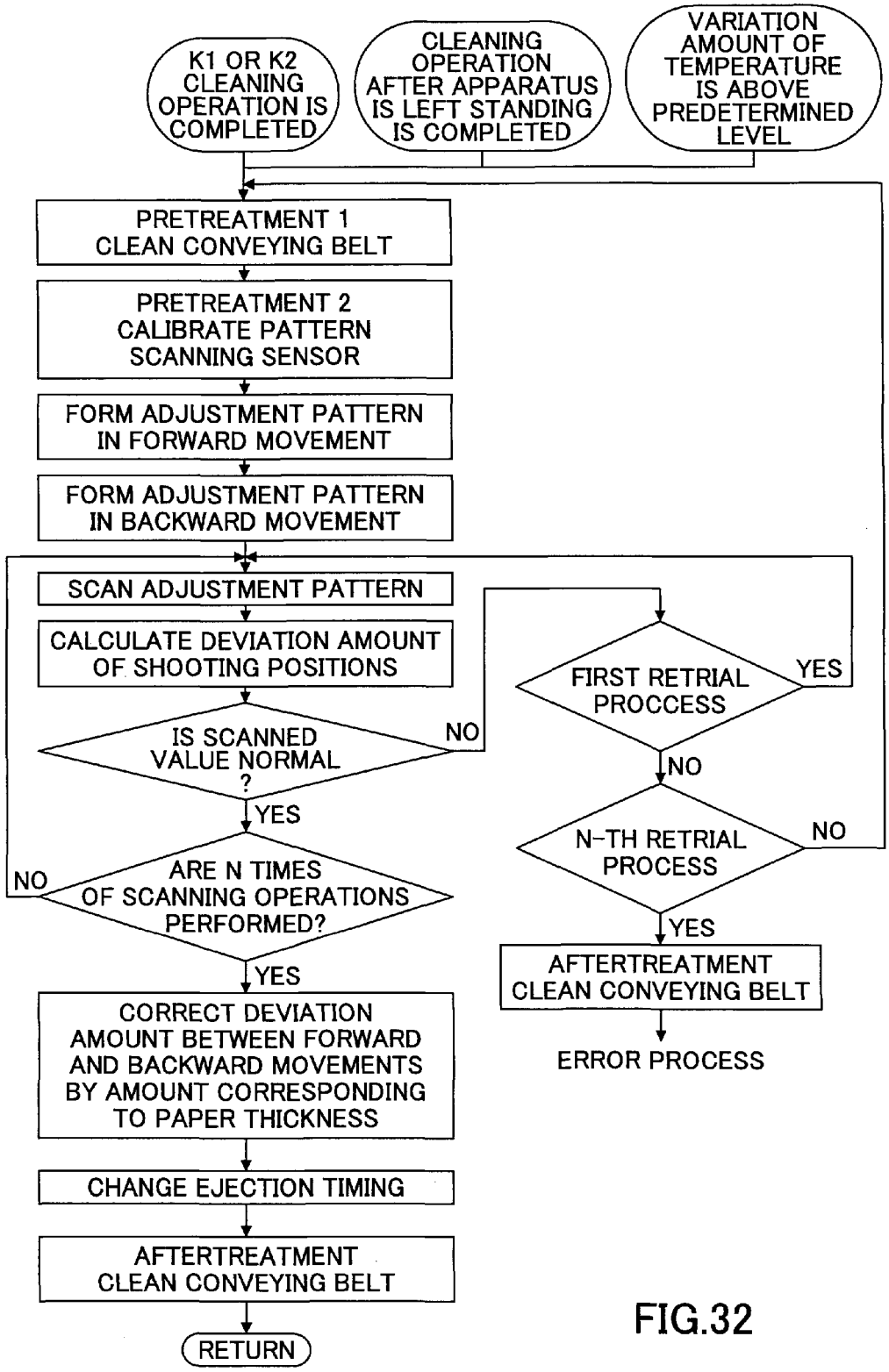
FIG. 32 is a flowchart of a process for adjusting (correcting) the deviation of shooting positions of liquid droplets.

Referring now to FIG. 32, a description is made of a process for adjusting (correcting) the deviation of the shooting positions of liquid droplets executed by the main controlling section 310.

This process is started when an k1 or k2 cleaning operation for maintaining and recovering the recording heads 24*k*1 and 24*k*2 that use black ink is completed, a cleaning operation performed after the apparatus is left standing is completed, and the variation amount of an environment temperature is above a predetermined level.

Then, cleaning of the conveying belt 31 is performed as a pretreatment 1, calibration of the pattern scanning sensor 401 is performed as a pretreatment 2, and the output of the light emitting element 402 is adjusted so that the output level of regular reflection light of the pattern scanning sensor 401 (light emitting element 402 and light receiving element 403) scanned by the carriage 23 becomes constant on the conveying belt 31.

Then, liquid droplets are ejected from the respective recording heads 24 while the carriage 23 is scanned forward in the main scanning direction, so that the patterns to be formed in the forward movement in the integrated adjustment pattern (adjustment pattern 400) as described in FIG. 31 are formed. Subsequently, liquid droplets are ejected from the respective recording heads 24 while the carriage 23 is scanned backward, so that the patterns to be formed in the backward movement in the integrated adjustment pattern (adjustment pattern 400) as described in FIG. 31 are formed.

After this, the carriage 23 is scanned forward in the main scanning direction with the light from the light emitting element 402 of the pattern scanning sensor 401 emitted so as to scan the adjustment pattern 400, and the shooting positions of the liquid droplets are detected based on the output of the light receiving element 403 of the pattern scanning sensor 401 so as to calculate the deviation amount of the shooting positions of the liquid droplets. As described above, the linear encoder is used to control the driving of the carriage 23 in this case. Therefore, the position of the carriage 23 at the time of detecting the positions of the ink droplets can be used as ejection coordinates of the ink droplets. As a result, it is possible to obtain a more accurate theoretical value between the patterns.

Then, it is determined whether the value scanned by the pattern scanning sensor 401 is normal. If the value is normal, it is determined whether N times of scanning operations are to be performed. If so, the process is returned to the scanning process. That is, the N times of scanning operations are repeatedly performed in the forward direction. When the N times of scanning operations are completed, the value for correcting liquid droplet ejection timing is calculated by correcting the deviation amount (reciprocating deviation amount) between the forward and backward movements of the carriage 23 by an amount corresponding to a paper thickness, thereby correcting print ejection timing based on the calculated liquid droplet ejection timing. After the correction of the print ejection timing, the surface of the conveying belt 31 is cleaned as an aftertreatment.

If the value scanned by the pattern scanning sensor 401 is abnormal, it is determined whether this is the first retrial process. If so, the process is returned to the process for scanning the adjustment pattern 400 again. If not, it is determined whether this is the N-th retrial process. If not, the process is returned to the process for forming the adjustment pattern 400 again. If the frequency of the retrial process reaches is N times, the process goes forward to the process for cleaning the surface of the conveying belt 31 as an aftertreatment. Then, the process goes forward to an error process.

According to the embodiment of the present invention, the reference pattern composed of plural independent liquid droplets and the pattern to be measured composed of plural independent liquid droplets ejected under the condition different from the reference pattern are formed parallel on the water-repellent member in the scanning direction of the recording heads. Furthermore, light is applied to the respective patterns and the regular reflection light is received therefrom so as to scan the patterns. Based on the scanned result, the distance between the patterns is measured so that the liquid droplet ejection timing of the recording heads is corrected. Therefore, it is possible to detect the shooting positions of liquid droplets with the simple configuration with high accuracy and correct the deviation of the shooting positions of liquid droplets with high accuracy.

Note that the above embodiment is made using the water-repellent member where the adjustment pattern is formed as the conveying belt, but a sheet material having a water-repellent property may be used separately.

The present invention is not limited to the specifically disclosed embodiments, and variations and modifications may be made without departing from the scope of the present invention.

The present application is based on Japanese Priority Application No. 2007-069673, filed on Mar. 17, 2007, the entire contents of which are hereby incorporated herein by reference.

What is claimed is:

1. An image forming apparatus that includes a recording head that ejects a liquid droplet and forms an image on a conveyed medium to be recorded, the apparatus comprising:

a pattern forming section that forms on a water-repellent member a reference pattern composed of plural independent liquid droplets and a pattern to be measured composed of plural independent liquid droplets ejected under an ejection condition different from the reference pattern so as to be arranged in parallel in a scanning direction of the recording head;

a scanning section composed of a light emitting section that emits light to the respective patterns and a light receiving section that receives regular reflection light from the respective patterns; and a correcting section that measures a distance between the respective patterns based on a scanned result of the scanning section and corrects liquid droplet ejection timing of the recording head based on the result thus measured.

2. The image forming apparatus according to claim 1, wherein the plural liquid droplets are regularly arranged in the respective patterns.

3. The image forming apparatus according to claim 1, wherein the plural liquid droplets are arranged at intervals of one dot in the respective patterns.

4. The image forming apparatus according to claim 1, wherein the plural liquid droplets are arranged in the respective patterns in a staggered manner.

5. The image forming apparatus according to claim 1, wherein plural of the reference patterns and the patterns to be measured are alternately formed.

6. The image forming apparatus according to claim 1, wherein the reference pattern and the pattern to be measured are formed by the same recording head in reversed scanning directions.

7. The image forming apparatus according to claim 1, wherein the reference pattern and the pattern to be measured are formed by different recording heads.

8. The image forming apparatus according to claim 1, wherein combinations of the reference pattern and the pattern to be measured are formed at plural parts on the water-repellent member.

9. The image forming apparatus according to claim 1, wherein the reference pattern and the pattern to be measured are not formed at a part where a surface property of the water-repellent member is changed.

10. A method of correcting a shooting position of a liquid droplet ejected from a recording head, the method comprising the steps of:

forming on a water-repellent member a reference pattern composed of plural independent liquid droplets and a pattern to be measured composed of plural independent liquid droplets ejected under an ejection condition different from the reference pattern so as to be arranged in parallel in a scanning direction of the recording head;

scanning the respective patterns by receiving regular reflection light from the respective patterns after applying light thereto; and correcting liquid droplet ejection timing of the recording head based on a measured result after measuring a distance between the respective patterns based on the scanned result.

* * * * *